US010304409B2

(12) United States Patent
You et al.

(10) Patent No.: US 10,304,409 B2
(45) Date of Patent: May 28, 2019

(54) ELECTRONIC DEVICE AND METHOD FOR REDUCING BURN-IN

(71) Applicant: Samsung Electronics Co., Ltd., Gyeonggi-do (KR)

(72) Inventors: Myoung-Soo You, Seoul (KR); Seung-Hwan Choi, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/061,935

(22) Filed: Mar. 4, 2016

(65) Prior Publication Data

US 2016/0260413 A1 Sep. 8, 2016

(30) Foreign Application Priority Data

Mar. 5, 2015 (KR) ..... 10-2015-0030940

(51) Int. Cl.
*G09G 5/00* (2006.01)
*G09G 5/10* (2006.01)
*G09G 3/32* (2016.01)

(52) U.S. Cl.
CPC ..... *G09G 5/10* (2013.01); *G09G 3/32* (2013.01); *G09G 5/003* (2013.01); *G09G 2320/046* (2013.01); *G09G 2320/103* (2013.01); *G09G 2360/04* (2013.01); *G09G 2370/042* (2013.01)

(58) Field of Classification Search
CPC . G09G 3/006; G09G 3/04; G09G 3/18; G06F 11/162; B60K 35/00
USPC ..... 345/618
See application file for complete search history.

(56) References Cited

U.S. PATENT DOCUMENTS 8,977,326 B2 * 3/2015 Pratt ..... G06F 1/3203 455/418
2007/0266345 A1 11/2007 Cok
2009/0179909 A1 * 7/2009 Fernandez ..... G09G 5/00 345/581
2010/0079475 A1 4/2010 Whitby-Strevens et al.
2012/0300061 A1 * 11/2012 Osman ..... G06F 1/3231 348/135
2014/0204127 A1 * 7/2014 Tann ..... H04N 7/0122 345/660

(Continued)

FOREIGN PATENT DOCUMENTS

EP 1 134 645 A1 9/2001
EP 2 375 738 A2 10/2011

(Continued)

OTHER PUBLICATIONS

European Search Report dated Jul. 27, 2016 in connection with European Patent Application No. EP 16158554.2.

*Primary Examiner* — Gordon G Liu

(57) ABSTRACT

An embodiment of this disclosure provides a method for reducing burn-in of a display. A burn-in reducing method may include outputting a first screen through a first display. The method also includes outputting a second screen through a second display of which a connection is detected. The method also includes determining whether a change occurs in the first screen that is output through the first display while the connection of the second display is detected. The method also includes modifying and outputting the first screen through the first display based on a result of the determination.

20 Claims, 14 Drawing Sheets

(56) References Cited

U.S. PATENT DOCUMENTS

2016/0188973 A1* 6/2016 Ziaja ..... G06F 21/84
382/116

FOREIGN PATENT DOCUMENTS

EP 2 672 376 A2 12/2013
KR 10-2011-0070046 A 6/2011

* cited by examiner

ELECTRONIC DEVICE AND METHOD FOR REDUCING BURN-IN

CROSS-REFERENCE TO RELATED APPLICATION AND CLAIM OF PRIORITY

The present application is related to and claims benefit under 35 U.S.C. § 119(a) to Korean Application Serial No. 10-2015-0030940, which was filed in the Korean Intellectual Property Office on Mar. 5, 2015, the entire content of which is hereby incorporated by reference.

TECHNICAL FIELD

The present disclosure relates to a method and electronic device for reducing burn-in. Specifically, the present disclosure relates to a method that modifies a screen displayed in a display so as to reduce burn-in will be disclosed.

BACKGROUND

Recently, when users use notebooks, tablet PCs, or the like, the users use external monitors through High Definition Multimedia Interfaces (HDMIs), miracast, short-range wireless communication, or the like, so as to use wider screens. For example, a user may perform internet browsing, perform word/excel documentation, watch videos, or play games using only an external monitor in the state where a notebook or a tablet PC outputs a setting screen on a white background.

SUMMARY

As described above, when an identical screen is continuously output through a notebook, a tablet PC, or the like without any change on the screen output, burn-in may occur by which a cell of a predetermined pixel on a display of the notebook, tablet PC, or the like is burned out and image sticking may remain. Also, when an Operating System (OS) used in the notebook, the tablet PC, or the like does not allow changing a User Interface (UI), the probability of burn-in may increase.

To address the above-discussed deficiencies, it is a primary object to provide a method and apparatus for reducing burn-in.

An embodiment of this disclosure provides a method of reducing burn-in occurring in a display of an electronic device. The method includes outputting a first screen through a first display. The method also includes outputting a second screen through a second display of which a connection is detected. The method also includes determining whether a change occurs in the first screen that is output through the first display while the connection of the second display is detected. The method also includes modifying and outputting the first screen through the first display based on a result of the determination.

Another embodiment of this disclosure provides an electronic device for reducing burn-in of a display. The electronic device includes a first display that outputs a first screen. The electronic device also includes a processor configured to determine whether a change occurs in the first screen that is output through the first display while a connection with a second display that outputs a second screen is detected. The processor is also configured to modify and output the first screen through the first display based on a result of the determination.

Yet another embodiment of this disclosure provides a method of reducing burn-in occurring in a display of an electronic device. The method includes outputting a first partial screen of a first screen through a first display. The method also includes outputting a second partial screen of the first screen through a second display of which a connection is detected. The method also includes, when it is determined that the connection of the second display is detected and the first partial screen has no change, modifying and outputting the first partial screen through the first display.

According to various embodiments of the present disclosure, an electronic device may reduce burn-in by changing a screen of a display when it is determined that a user does not use the display. This operation is processed in a device driver end and thus, even when the operating system used in the electronic device does not allow changing a user interface, burn-in occurring in the display of the electronic device may be reduced. Also, a method of reducing burn-in based on a type of display may be applied by adjusting the degree of a change occurring in the screen based on a type of display.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
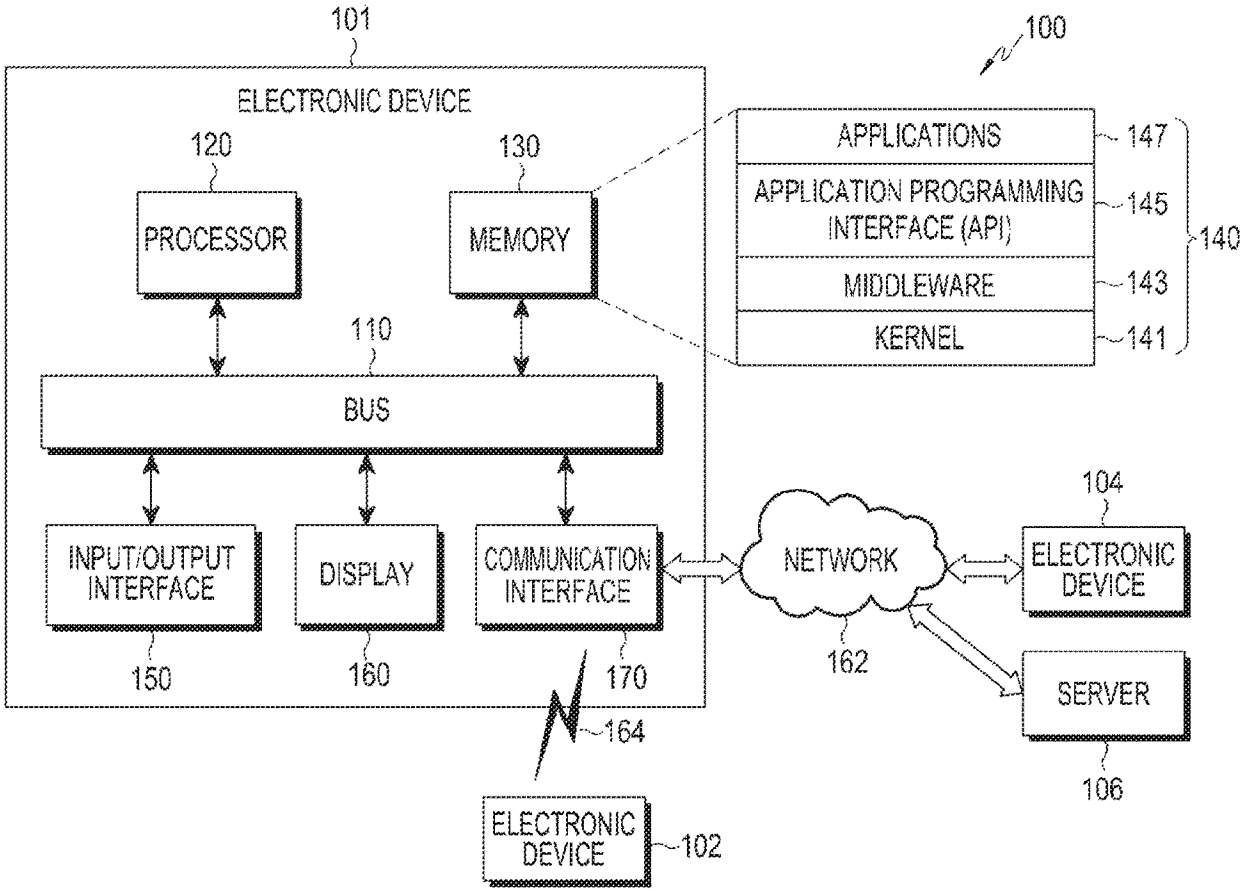
FIG. 1 illustrates a network environment including an electronic device according to various embodiments of the present disclosure.

FIGS. 1 through 15, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged method or apparatus.

Hereinafter, various embodiments of the present disclosure will be described with reference to the accompanying drawings. However, it should be understood that there is no intent to limit the present disclosure to the particular forms disclosed herein; rather, the present disclosure should be construed to cover various modifications, equivalents, and/or alternatives of embodiments of the present disclosure. In describing the drawings, similar reference numerals may be used to designate similar constituent elements.

As used herein, the expression "have", "may have", "include", or "may include" refers to the existence of a corresponding feature (e.g., numeral, function, operation, or constituent element such as component), and does not exclude one or more additional features.

In the present disclosure, the expression "A or B", "at least one of A or/and B", or "one or more of A or/and B" may include all possible combinations of the items listed. For example, the expression "A or B", "at least one of A and B", or "at least one of A or B" refers to all of (1) including at least one A, (2) including at least one B, or (3) including all of at least one A and at least one B.

The expression "a first", "a second", "the first", or "the second" used in various embodiments of the present disclosure may modify various components regardless of the order and/or the importance but does not limit the corresponding components. For example, a first user device and a second user device indicate different user devices although both of them are user devices. For example, a first element may be termed a second element, and similarly, a second element may be termed a first element without departing from the scope of the present disclosure.

It should be understood that when an element (e.g., first element) is referred to as being (operatively or communicatively) "connected," or "coupled," to another element (e.g., second element), it may be directly connected or coupled directly to the other element or any other element (e.g., third element) may be interposer between them. In contrast, it may be understood that when an element (e.g., first element) is referred to as being "directly connected," or "directly coupled" to another element (second element), there are no element (e.g., third element) interposed between them.

The expression "configured to" used in the present disclosure may be exchanged with, for example, "suitable for", "having the capacity to", "designed to", "adapted to", "made to", or "capable of" according to the situation. The term "configured to" may not necessarily imply "specifically designed to" in hardware. Alternatively, in some situations, the expression "device configured to" may mean that the device, together with other devices or components, "is able to". For example, the phrase "processor adapted (or configured) to perform A, B, and C" may mean a dedicated processor (e.g. embedded processor) only for performing the corresponding operations or a generic-purpose processor (e.g., central processing unit (CPU) or application processor (AP)) that can perform the corresponding operations by executing one or more software programs stored in a memory device.

The terms used herein are merely for the purpose of describing particular embodiments and are not intended to limit the scope of other embodiments. As used herein, singular forms may include plural forms as well unless the context clearly indicates otherwise. Unless defined otherwise, all terms used herein, including technical and scientific terms, have the same meaning as those commonly understood by a person skilled in the art to which the present disclosure pertains. Such terms as those defined in a generally used dictionary may be interpreted to have the meanings equal to the contextual meanings in the relevant field of art, and are not to be interpreted to have ideal or excessively formal meanings unless clearly defined in the present disclosure. In some embodiments, even the term defined in the present disclosure should not be interpreted to exclude embodiments of the present disclosure.

An electronic device according to various embodiments of the present disclosure may include at least one of, for example, a smart phone, a tablet Personal Computer (PC), a mobile phone, a video phone, an electronic book reader (e-book reader), a desktop PC, a laptop PC, a netbook computer, a workstation, a server, a Personal Digital Assistant (PDA), a Portable Multimedia Player (PMP), a MPEG-1 audio layer-3 (MP3) player, a mobile medical device, a camera, and a wearable device. According to various embodiments, the wearable device may include at least one of an accessory type (e.g., a watch, a ring, a bracelet, an anklet, a necklace, a glasses, a contact lens, or a Head-Mounted Device (HMD)), a fabric or clothing integrated type (e.g., an electronic clothing), a body-mounted type (e.g., a skin pad, or tattoo), and a bio-implantable type (e.g., an implantable circuit).

According to some embodiments, the electronic device may be a home appliance. The home appliance may include at least one of, for example, a television, a Digital Video Disk (DVD) player, an audio, a refrigerator, an air conditioner, a vacuum cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ and PlayStation™), an electronic dictionary, an electronic key, a camcorder, and an electronic photo frame.

According to another embodiment, the electronic device may include at least one of various medical devices (e.g., various portable medical measuring devices (a blood glucose monitoring device, a heart rate monitoring device, a blood pressure measuring device, a body temperature measuring device, and the like), a Magnetic Resonance Angiography (MRA), a Magnetic Resonance Imaging (MRI), a Computed Tomography (CT) machine, and an ultrasonic machine), a navigation device, a Global Positioning System (GPS) receiver, an Event Data Recorder (EDR), a Flight Data Recorder (FDR), a Vehicle Infotainment Devices, an electronic devices for a ship (e.g., a navigation device for a ship, and a gyro-compass), avionics, security devices, an automotive head unit, a robot for home or industry, an automatic teller's machine (ATM) in banks, point of sales (POS) in a shop, or internet device of things (e.g., a light bulb, various sensors, electric or gas meter, a sprinkler device, a fire alarm, a thermostat, a streetlamp, a toaster, a sporting goods, a hot water tank, a heater, a boiler, and the like).

According to some embodiments, the electronic device may include at least one of a part of furniture or a building/structure, an electronic board, an electronic signature receiving device, a projector, and various kinds of measuring instruments (e.g., a water meter, an electric meter, a gas meter, and a radio wave meter). The electronic device according to various embodiments of the present disclosure may be a combination of one or more of the aforementioned various devices. The electronic device according to some embodiments of the present disclosure may be a flexible device. Further, the electronic device according to an embodiment of the present disclosure is not limited to the aforementioned devices, and may include a new electronic device according to the development of technology Hereinafter, an electronic device according to various embodiments will be described with reference to the accompanying drawings. As used herein, the term "user" may indicate a person who uses an electronic device or a device (e.g., an artificial intelligence electronic device) that uses an electronic device. An electronic device 101 in a network environment 100, according to various embodiments of the present disclosure, is described with reference to FIG. 1. The electronic device 101 may include a bus 110, a processor 120, a memory 130, an input/output interface 150, a display 160, and a communication interface 170. According to an embodiment of the present disclosure, the electronic device 101 may omit at least one of the above component elements or may further include other component elements.

The bus 110 may include, for example, a circuit for connecting the component elements 110 to 170 and transferring communication (e.g., control messages and/or data) between the component elements.

The processor 120 may include one or more of a Central Processing Unit (CPU), an Application Processor (AP), and a Communication Processor (CP). The processor 120, for example, may carry out operations or data processing relating to the control and/or communication of at least one other component element of the electronic device 101.

The memory 130 may include a volatile memory and/or a non-volatile memory. The memory 130 may store, for example, instructions or data relevant to at least one other component element of the electronic device 101. According to an embodiment of the present disclosure, the memory 130 may store software and/or a program 140. The program 140 may include, for example, a kernel 141, middleware 143, an Application Programming Interface (API) 145, and/or application programs (or "applications") 147. At least some of the kernel 141, the middleware 143, and the API 145 may be referred to as an Operating System (OS).

The kernel 141 may control or manage system resources (e.g., the bus 110, the processor 120, or the memory 130) that are used for performing an operation or function implemented by the other programs (e.g., the middleware 143, the API 145, or the application programs 147). Furthermore, the kernel 141 may provide an interface through which the middleware 143, the API 145, or the application programs 147 may access the individual component elements of the electronic device 101 to control or manage the system resources.

The middleware 143, for example, may serve as an intermediary for allowing the API 145 or the application programs 147 to communicate with the kernel 141 to exchange data.

In addition, the middleware 143 may process one or more task requests received from the application programs 147 according to priorities thereof. For example, the middleware 143 may assign priorities for using the system resources (e.g., the bus 110, the processor 120, the memory 130, or like) of the electronic device 101 to at least one of the application programs 147. For example, the middleware 143 may perform scheduling or load balancing on the one or more task requests by processing the one or more task requests according to the priorities assigned thereto.

The API 145, for example, is an interface through which the applications 147 control functions provided from the kernel 141 or the middleware 143, and may include, for example, at least one interface or function (e.g., instruction) for file control, window control, image processing, text control, or the like.

The input/output interface 150, for example, may serve as an interface that may transfer instructions or data input from a user or another external device to the other component element(s) of the electronic device 101. Furthermore, the input/output interface 150 may output the instructions or data received from the other component element(s) of the electronic device 101 to the user or another external device.

The display 160 may include, for example, a Liquid Crystal Display (LCD), a Light-Emitting Diode (LED) display, an Organic Light-Emitting Diode (OLED) display, a MicroElectroMechanical Systems (MEMS) display, or an electronic paper display. The display 160 may display, for example, various types of contents (e.g., text, images, videos, icons, symbols, or the like) to the user. The display 160 may include a touch screen and receive, for example, a touch, gesture, proximity, or hovering input using an electronic pen or a user's body part.

The communication interface 170, for example, may set communication between the electronic device 101 and an external device (e.g., a first external electronic device 102, a second external electronic device 104, or a server 106). For example, the communication interface 170 may be connected to a network 162 through wireless or wired communication to communicate with an external device (e.g., the second external electronic device 104 or the server 106).

The wireless communication may use at least one of, for example, Long Term Evolution (LTE), LTE-Advance (LTE-A), Code Division Multiple Access (CDMA), Wideband CDMA (WCDMA), Universal Mobile Telecommunications System (UMTS), WiBro (Wireless Broadband), and Global System for Mobile Communications (GSM), as a cellular communication protocol. In addition, the wireless communication may include, for example, a short range communication 164. The short-range communication 164 may include at least one of, for example, Wi-Fi, Bluetooth, Near Field Communication (NFC), and a Global Navigation Satellite System (GNSS), and the like. The GNSS may include at least one of, for example, a Global Positioning System (GPS), a Global Navigation Satellite System (Glonass), a Beidou Navigation Satellite System (hereinafter referred to as "Beidou"), and a European Global Satellite-based Navigation System (Galileo), according to a use area, a bandwidth, or the like. Hereinafter, in the present disclosure, the "GPS" may be interchangeably used with the "GNSS". The wired communication may include at least one of, for example, a Universal Serial Bus (USB), a High Definition Multimedia Interface (HDMI), Recommended Standard 232 (RS-232), and a Plain Old Telephone Service (POTS). The network 162 may include at least one of a communication network, such as a computer network (e.g., LAN or WAN), the Internet, and a telephone network.

Each of the first and second external electronic devices 102 and 104 may be of a type that is identical to or different from that of the electronic device 101. According to an embodiment of the present disclosure, the server 106 may include a group of one or more servers. According to various embodiments of the present disclosure, all or some of the operations performed in the electronic device 101 may be performed in another electronic device or a plurality of electronic devices (e.g., the electronic devices 102 and 104, or the server 106). According to an embodiment of the present disclosure, when the electronic device 101 has to perform some functions or services automatically or by request, the electronic device 101 may make a request for performing at least some functions relating thereto to another device (e.g., the electronic device 102 or 104, or the server 106) instead of, or in addition to, performing the functions or services by itself. Another electronic device (e.g., the electronic devices 102 and 104, or the server 106) may execute the requested functions or the additional functions, and may deliver a result of the execution to the electronic device 101. The electronic device 101 may process the received result as it is or additionally to provide the requested functions or services. To achieve this, for example, cloud computing, distributed computing, or client-server computing technology may be used.

A first display (e.g., the display 160), according to various embodiments of the present disclosure, may output a first screen. When a second display (e.g., an external monitor such as TV or the like) is connected to the electronic device 101, a screen to be output through the second display may be determined based on a display operation mode set in an operating system that drives the electronic device 101.

For example, when the display operation mode of the electronic device 101 is set to a duplicated mode, the electronic device 101 may output an identical screen to the first display and the second display.

Also, when the display operation mode of the electronic device 101 is set to an extended mode, the processor 120 may execute a control to output different screens to the first display and the second display. For example, the processor 120 may output a first partial screen of the first screen through the first display, and output a second partial screen of the first screen, which is different from the first partial screen, through the second display.

As described above, the processor 120 may determine the screens to be output through the first display and the connected second display based on the set display operation mode. When the display operation mode of the electronic device 101 is a duplicated mode, the first display and the second display output an identical screen. Accordingly, the number of situations that one of the two displays continuously output an identical screen may be decreased, and thus, the frequency of burn-in occurring in the first display and the second display may not be high. However, the duplicated mode and the extended mode, which are the display operation modes, are used for illustrative purposes; the present disclosure may not be limited thereto. The display operation mode of the electronic device 101 may be variously set, and the electronic device 101 may output a screen that is based on a display operation mode that can be variously set through the second display as the second display is connected.

The second display, according to various embodiments of the present disclosure, may be connected to the electronic device 101. The second display may be connected to the electronic device 101 through an HDMI, a DVI (Digital Visual Interface), an MHL (Mobile High-Definition Link), or a USB (Universal Serial Bus) port of the electronic device 101, or through a short-range wireless communication, or the like. As described above, based on the display operation mode of the electronic device 101, a screen to be output through the second display may be determined. For example, when the second display outputs a second screen, and the display operation mode of the electronic device 101 is the duplicated mode, the first screen and the second screen may be identical to each other. Conversely, when the display operation mode of the electronic device 101 is the extended mode, the first screen and the second screen are different from one another.

According to an embodiment of the present disclosure, the processor 120 may execute a process to display an instruction execution result, a processing result, or the like that corresponds to a user input as the first screen or the second screen through the first display or the second display.

The processor 120, according to various embodiments of the present disclosure, may determine whether a change occurs in the first screen that is output through the first display, as a connection of the second display is detected. For example, the processor 120 may determine whether the first screen has a change. Also, the processor 120 may determine whether the first screen has a change based on the entire first screen or at least a part of the first screen, which is set in advance. For example, an area where a change continuously occurs (e.g., a time display area on a window menu bar or the like), even though an input is not obtained from a user, may not be used for determining whether the first screen has a change.

The processor 120, according to various embodiments of the present disclosure, may modify and output the first screen through the first display based on a result of the determination. When it is determined that the first screen output through the first display has no change during a predetermined period of time, the first screen may be modified and output through the first display. When the first screen that is output through the first display has no change during the predetermined period of time, the first screen may be continuously output through the first display. In this instance, burn-in may occur in the first display and image sticking may remain. Therefore, when it is determined that the first screen has no change, the processor 120 modifies and outputs the first screen through the first display, and thus, may reduce the burn-in that may occur in the first display.

According to an embodiment of the present disclosure, the first screen that is modified and output may be at least one of a screen obtained by changing the brightness of at least a part of the first screen, a screen obtained by applying a blurring effect to at least a part of the first screen, a screen obtained by changing the transparency of at least a part of the first screen, a screen obtained by applying a screen saver to at least a part of the first screen, and a screen that does not output information in at least a part of the first screen. As described above, the processor 120 may modify the entire first screen or may modify at least a part of the first screen, and may display the same to reduce the burn-in.

The processor 120 may change the brightness of the first screen by dimming the first display. For example, the processor 120 may change the brightness of the first screen by adjusting the voltage value of each pixel of the first display. Also, the processor 120 may change the brightness of the first screen by adjusting the brightness of a backlight of the first display.

Also, the processor 120 may apply a blurring effect to the first screen. By applying the blurring effect to the first screen, the processor 120 may decrease the contrast in a boundary area between objects included in the first screen. For example, the processor 120 groups pixels of the first display and reassigns each pixel with an average value of a pixel group to which a corresponding pixel belongs as a pixel value, so as to apply the blurring effect to the first screen.

Also, the processor 120 may change the transparency of the first screen. For example, the processor 120 may change the transparency of the first screen by using a transparency applying filter that is included in an On Screen Display (OSD) of the first display.

Through the brightness changing method, the blurring effect applying method, and the transparency changing method, the processor 120 may reduce the burn-in that may occur in the first display.

The method of changing the first screen is merely an example for illustrative purposes; the present disclosure may not be limited thereto. The first screen may be modified through a method of reducing burn-in of the first display in addition to the above described methods, and may be output through the first display.

According to an embodiment of the present disclosure, the first screen may be modified and output based on a type of the first display. A sensitivity to burn-in may be different based on a type of display. For example, an Active Matrix Organic Light Emitting Diode (AMOLED) display has a high sensitivity to burn-in, and a Liquid Crystal Display (LCD) may have a lower sensitivity to burn-in when compared to the AMOLED display. Therefore, the processor 120 may apply a degree of a change to be made in the first screen to be different based on a type of the first display. For example, the processor 120 may apply a brightness value and a transparency of the first screen, and a blurring effect applied to the first partial screen, to be different based on a type of the first display.

According to an embodiment of the present disclosure, when it is determine that the first screen has a change, the processor 120 may control the first display to output the first screen. The processor 120 modifies the first screen and displays the same through the first display, and then, determines whether the modified first screen has a change. When it is determined that the modified first screen has a change, the processor 120 may enable the existing first screen to be output through the first display.

According to an embodiment of the present disclosure, the communication module (e.g., the communication interface 170) may receive, from the first display, type information associated with the second display. For example, the communication module may determine the type information associated with the second display included in Extended Display Identification Data (EDID) information that is received from the second display.

According to an embodiment of the present disclosure, the processor 120 may determine whether to modify the second screen that is displayed through the second display, based on the received type information associated with the second display. For example, when it is determined that the second display is not of the type that is sensitive to burn-in, based on a type of the second display, the processor 120 may not modify the second screen even when the second screen has no change.

According to an embodiment of the present disclosure, when it is determined that the second screen that is output through the second display has no change during a predetermined period of time, the processor 120 may control the second display to modify and output the second screen, based on the received type information associated with the second display. The processor 120 may modify and output the second display that is output through the second display, so as to reduce burn-in that may occur in the second display.

According to an embodiment of the present disclosure, the modified second screen may be at least one of a screen obtained by changing the brightness of at least a part of the second screen, a screen obtained by applying a blurring effect to at least a part of the second screen, a screen obtained by changing the transparency of at least a part of the second screen, a screen obtained by applying a screen saver to at least a part of the second screen, and a screen that does not output information in at least a part of the second screen, based on the received type information associated with the second display. As describe above, based on the type information of the second display, a degree of a change to be made in the second screen may be determined.

According to an embodiment of the present disclosure, when the change made in the first screen during a predetermined period of time is less than a threshold value, it is determined that the first screen has no change. When the first screen does not change at all and a change in the first screen is less than a threshold value, the processor 120 may determine that the first screen has no change. Also, when a change does not occur in a part of the first screen that is set in advance, the processor 120 may determine that the first screen has no change.

For example, a change may occur in a predetermined area (e.g., a time display area of a window menu bar, or the like) of the first screen, and a change may not occur in the other area of the first screen remaining after excluding the predetermined area. In this instance, burn-in may occur in the area of the first display corresponding to the other area of the first screen remaining after excluding the predetermined area where the change occurs. Also, when a change does not occur in a predetermined area (e.g., a task bar (start button), an Internet browser bar, or the like) of the first screen, and a change occurs only in other area of the first screen remaining after excluding the predetermined area, burn-in may occur in the area of the first display corresponding to the predetermined area where a change does not occur. Therefore, when a change in the first screen is less than a threshold value, the processor 120 may determine that the first screen has no change.

According to an embodiment of the present disclosure, when a user input corresponding to the first screen is not obtained during a predetermined period of time, the processor 120 may determine that the first screen has no change. The processor 120 may determine whether the user input is obtained through information on whether a User Interface (UI) (e.g., a mouse pointer, a cursor, or the like) associated with the user input is displayed or moves in the first screen. For example, when a mouse pointer moves from the second screen to the first screen, the processor 120 may determine that the user input is obtained based on a degree of a movement state of the mouse pointer in the first screen.

Figure 2:
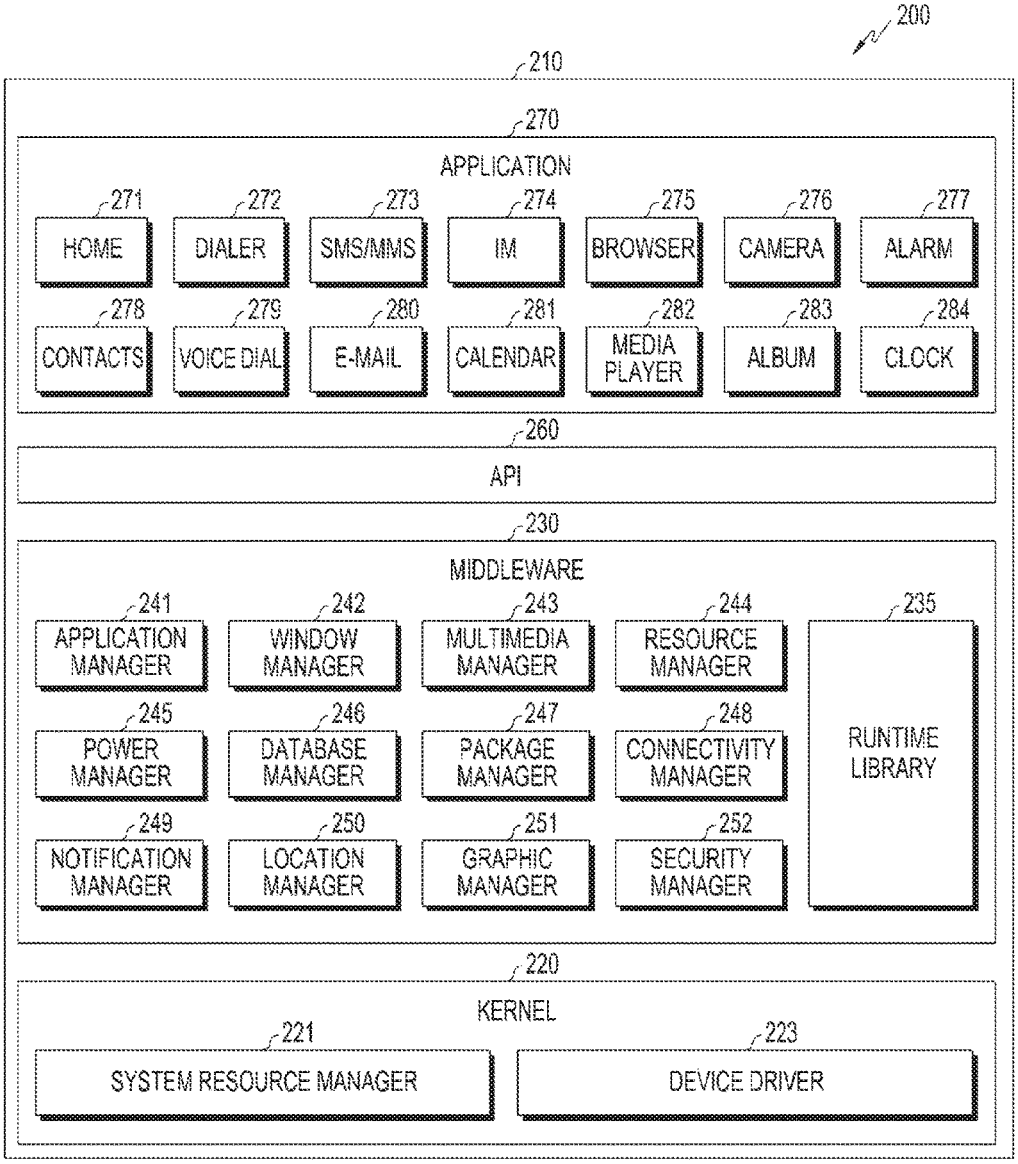
FIG. 2 illustrates a block diagram of a program module according to various embodiments of the present disclosure.

FIG. 2 illustrates a block diagram of a program module according to various embodiments of the present disclosure. According to an embodiment of the present disclosure, the program module 210 (e.g., the program 140) may include an Operating System (OS) for controlling resources related to the electronic device (e.g., the electronic device 101) and/or various applications (e.g., the application programs 147) executed in the operating system. The operating system may be, for example, ANDROID, IOS, WINDOWS, SYMBIAN, TIZEN, BADA, or the like.

The program module 210 may include a kernel 220, middleware 230, an Application Programming Interface (API) 260, and/or applications 270. At least some of the program module 210 may be preloaded on the electronic device, or may be downloaded from an external electronic device (e.g., the electronic device 102 or 104, or the server 106).

The kernel 220 (e.g., the kernel 141) may include, for example, a system resource manager 221 and/or a device driver 223. The system resource manager 221 may perform the control, allocation, collection, or the like of system resources. According to an embodiment of the present disclosure, the system resource manager 221 may include a process manager, a memory manager, a file system manager, or the like. The device driver 223 may include, for example, a display driver, a camera driver, a Bluetooth driver, a shared memory driver, a USB driver, a keypad driver, a Wi-Fi driver, an audio driver, or an Inter-Process Communication (IPC) driver.

The middleware 230 may provide a function used by the applications 270 in common, or may provide various functions to the applications 270 through the API 260 such that the applications 270 can efficiently use limited system resources within an electronic device. According to an embodiment of the present disclosure, the middleware 230 (e.g., the middleware 143) may include, for example, at least one of a runtime library 235, an application manager 241, a window manager 242, a multimedia manager 243, a resource manager 244, a power manager 245, a database manager 246, a package manager 247, a connectivity manager 248, a notification manager 249, a location manager 250, a graphic manager 251, and a security manager 252.

The runtime library 235 may include a library module which a compiler uses in order to add a new function through a programming language while the applications 270 are being executed. The runtime library 235 may perform input/output management, memory management, the functionality for an arithmetic function, or the like.

The application manager 241 may manage, for example, a life cycle of at least one of the applications 270. The window manager 242 may manage Graphical User Interface (GUI) resources used for a screen. The multimedia manager 243 may determine a format used to reproduce various media files, and may encode or decode a media file by using a coder/decoder (codec) that is appropriate for the corresponding format. The resource manager 244 may manage resources, such as a source code, a memory, a storage space, and the like of at least one of the applications 270.

The power manager 245 may operate together with a Basic Input/Output System (BIOS) or the like to manage a battery or power, and may provide power information used for the operation of the electronic device. The database manager 246 may generate, search for, and/or change a database to be used by at least one of the applications 270. The package manager 247 may manage the installation or update of an application distributed in the form of a package file.

The connectivity manager 248 may manage a wireless connection, such as, for example, Wi-Fi, Bluetooth, or the like. The notification manager 249 may display or notify of an event, such as an arrival message, an appointment, a proximity notification, and the like, in such a manner so as not to disturb the user. The location manager 250 may manage location information of an electronic device. The graphic manager 251 may manage a graphic effect, which is to be provided to the user, or a user interface related to the graphic effect. The security manager 252 may provide various security functions used for system security, user authentication, and the like. According to an embodiment of the present disclosure, when an electronic device (e.g., the electronic device 101) has a telephone call function, the middleware 230 may further include a telephony manager for managing a voice call function or a video call function of the electronic device.

The middleware 230 may include a middleware module that forms a combination of various functions of the above-described elements. The middleware 230 may provide a module that is specialized for each type of operating system in order to provide a differentiated function. Also, the middleware 230 may dynamically delete some of the existing component elements, or may add new component elements.

The API 260 (e.g., the API 145) is, for example, a set of API programming functions, and may be provided with a different configuration based on an operating system. For example, in the example of Android or iOS, one API set may be provided for each platform. In the example of Tizen, two or more API sets may be provided for each platform.

The applications 270 (e.g., the application programs 147) may include, for example, one or more applications that can provide functions, such as home 271, dialer 272, SMS/MMS 273, Instant Message (IM) 274, browser 275, camera 276, alarm 277, contacts 278, voice dial 279, email 280, calendar 281, media player 282, album 283, clock 284, health care (e.g., measure exercise quantity or blood sugar), or environment information (e.g., atmospheric pressure, humidity, or temperature information).

According to an embodiment of the present disclosure, the applications 270 may include an application (hereinafter, referred to as an "information exchange application" for convenience of description) that supports exchanging information between the electronic device (e.g., the electronic device 101) and an external electronic device (e.g., the electronic device 102 or 104). The information exchange application may include, for example, a notification relay application for transferring specific information to an external electronic device or a device management application for managing an external electronic device.

For example, the notification relay application may include a function of transferring, to the external electronic device (e.g., the electronic device 102 or 104), notification information generated from other applications of the electronic device 101 (e.g., an SMS/MMS application, an e-mail application, a health management application, an environmental information application, or the like). Further, the notification relay application may receive notification information from, for example, an external electronic device and may provide the received notification information to a user.

The device management application may manage (e.g., install, delete, or update), for example, at least a function (e.g., turning on/off the external electronic device itself (or some component elements thereof) or adjusting brightness (or resolution) of a display) of an external electronic device (e.g., the electronic device 102 or 104) communicating with an electronic device, applications executed in the external electronic device, or services provided from the external electronic device (e.g., a telephone call service or a message service).

According to an embodiment of the present disclosure, the applications 270 may include applications (e.g., a health care application of a mobile medical appliance or the like) designated according to attributes of an external electronic device 102 or 104. According to an embodiment of the present disclosure, the application 270 may include an application received from an external electronic device (e.g., the server 106, or the electronic device 102 or 104). According to an embodiment of the present disclosure, the application 270 may include a preloaded application or a third party application, which may be downloaded from a server. Names of the elements of the program module 210, according to the above-described embodiments of the present disclosure, may change depending on the type of OS.

According to various exemplary embodiments of the present disclosure, at least some of the program module 210 may be implemented in software, firmware, hardware, or a combination of two or more thereof. At least some of the program module 210 may be implemented (e.g., executed) by, for example, the processor (e.g., the processor 210). At least some of the program module 210 may include, for example, a module, a program, a routine, a set of instructions, and/or a process for performing one or more functions.

Figure 3:
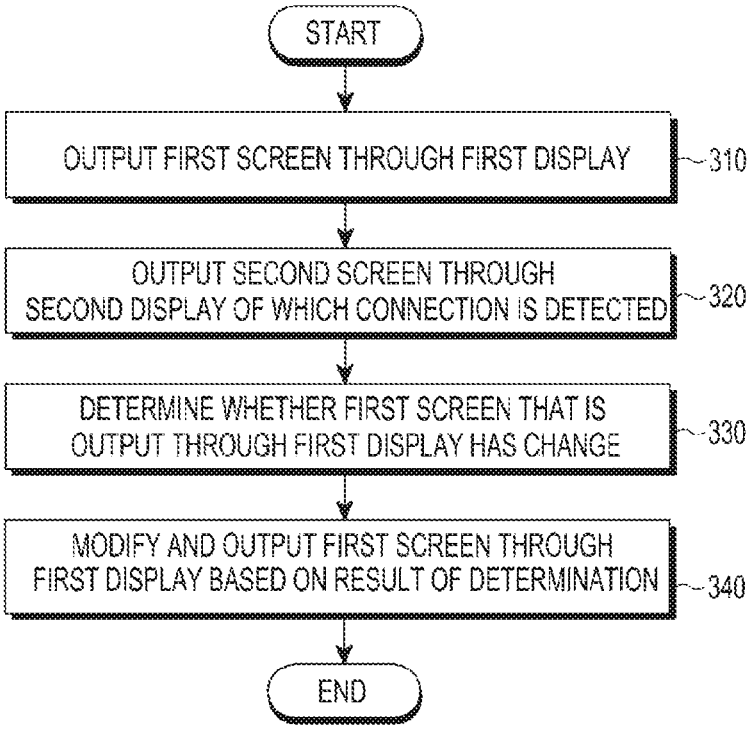
FIG. 3 illustrates a flowchart of a burn-in reducing method of an electronic device according to various embodiments of the present disclosure.

FIG. 3 illustrates a process for a burn-in reducing method of an electronic device according to various embodiments of the present disclosure.

In operation 310, the electronic device 101 outputs a first screen through a first display. When a second display is connected, the electronic device 101 may determine a display operation mode of the electronic device 101. The electronic device 101 may determine screens to be output through the first display and the second display, based on the determined operation mode.

In operation 320, the electronic device 101 outputs a second screen through the second display of which a connection is detected. The second display may be connected to the electronic device 101 through a DVI, HDMI, or MEIL port of the electronic device 101, or through short-range wireless communication (e.g., miracast using WiFi Direct or the like). Also, the second display may be connected through a USB port of the electronic device 101. As described above, a second screen, which is determined based on the set display operation mode of the electronic device 101, may be output through the second display.

In operation 330, the electronic device 101 may determine whether a change occurs in the first screen that is output through the first display, as the connection of the second display is detected. For example, the processor 120 may determine whether the first screen has a change, based on the entire first screen or at least a part of the first screen, set in advance.

In operation 340, the electronic device 101 modifies and outputs the first screen through the first display based on a result of the determination. When the first screen that is output through the first display has no change, burn-in may occur in the first display and image sticking may remain.

Therefore, when it is determined that the first screen has no change during a predetermined period of time, the electronic device 101 may modify and output the first screen. For example, the electronic device 101 may output the first screen by applying a burn-in resistant processing, such as applying dimming, blurring, transparency, or the like. Through the above, the electronic device 101 may reduce burn-in that may occur in the first display.

Figure 4A:
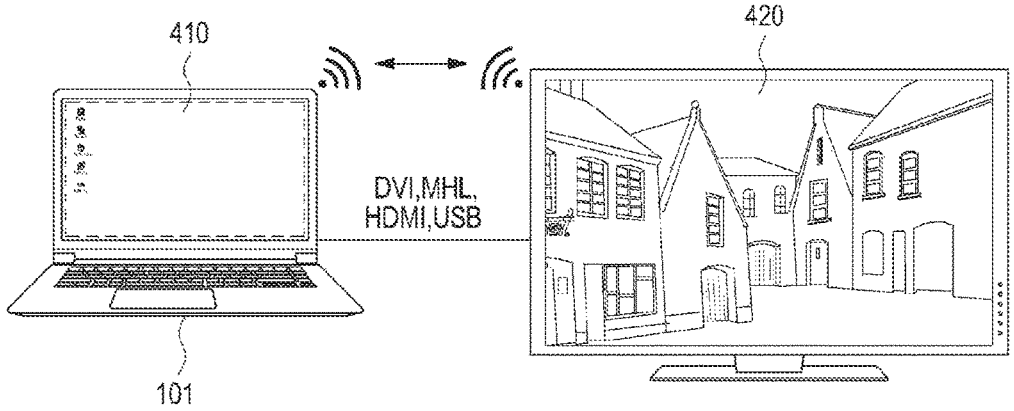
FIGS. 4A and 4B illustrate diagrams of a relationship between an electronic device and a display that is connected with the electronic device, and a burn-in reducing method according to various embodiments of the present disclosure.
Figure 4B:
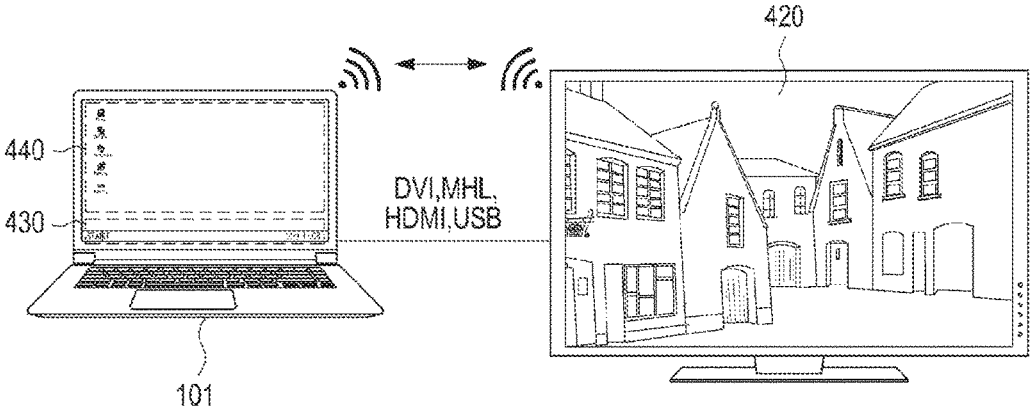

FIGS. 4A and 4B illustrate diagrams of a relationship between an electronic device and a display that is connected with the electronic device, and a burn-in reducing method according to an embodiment of the present disclosure.

As described in FIG. 4A, a first screen may be output through a first display 410 of the electronic device 101, and a second screen that is different from the first screen may be output through a second display 420 that is connected to the electronic device 101 through a DVI, MEIL, HDMI, or USB port, or through short-range communication or the like, For example, a user may connect the second display 420 that displays a broader screen than the first display 410, to the electronic device 101. As illustrated in FIG. 4A, the first display 410 and the second display 420 may be connected wiredly or wirelessly. The user may perform Internet browsing, may work on word/excel documentation, watch videos, or play games through the second display 420.

According to an embodiment of the present disclosure, the electronic device 101 may determine whether the first screen has a change, as the second display 420 is connected. For example, a screen where an application used by the user is displayed continuously changes, but a screen displayed in the display where the application used by the user is not displayed may have no change. For example, when an execution screen of an application used by the user is displayed through the second display 420, and only a basic screen provided by an operating system (OS) is displayed in the first display 410, as illustrated in FIG. 4A.

In this instance, the second screen displayed in the second display 420 continuously changes, and thus, the probability of burn-in occurring in the second display may be low. However, the first screen output through the first display 410 is constantly maintained as the basic screen, and thus, burn-in may occur in the first display. Therefore, when it is determined that the first screen that is output through the first display has no change during a predetermined period of time, the electronic device 101 may modify and output the first screen. Through the above, the electronic device 101 may reduce burn-in that may occur in the first display.

In FIG. 4B, a method will be described in which the electronic device 101 determines that the first screen has no change when a change in the first screen is less than a threshold value.

A change may occur in only a predetermined area 430 of the first screen and a change may not occur in other area 440 of the first screen remaining after excluding the predetermined area. Referring to FIG. 4B, in a time display area on a window menu bar, which is the predetermined area 430 of the first screen, a change may continuously occur over time even though a user input is not obtained. Conversely, in the other area 440 of the first screen, a change does not occur when a user input is not obtained. Accordingly, burn-in may occur in the area of the first display corresponding to the other area 440 of the first screen.

As described above, when a change in the first screen that is output through the first display is less than a threshold value, the electronic device 101 may also determine that the first screen has no change. In this instance, therefore, the electronic device 101 may modify and output the first screen.

Also, according to an embodiment of the present disclosure, the electronic device 101 may output the first screen by changing only the other area 440 of the first screen, as opposed to changing the entire first screen. Since a change occurs in the predetermined area 430 of the first screen, the electronic device 101 may output the first screen by applying the burn-in resistant processing to only the other area 440 of the first screen.

Figure 5:
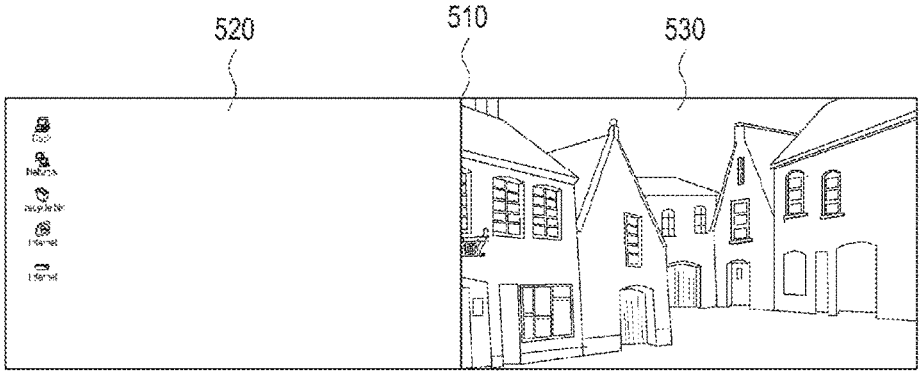
FIG. 5 illustrates a diagram of a relationship between a screen and a partial screen according to an embodiment of the present disclosure.

FIG. 5 illustrates a diagram of a relationship between a screen and a partial screen according to an embodiment of the present disclosure.

In FIG. 5, when a display operation mode of the electronic device 101 is an extended mode, a relationship between a screen output through the first display and a screen output through the second display will be described.

For example, when the display operation mode of the electronic device 101 is the extended mode, the electronic device 101 may divide a first screen 510 and output the same through the connected first and the second displays.

The electronic device 101 may output a first partial screen 520 of the first screen 510 through the first display, and may output a second partial screen 530 of the first screen 510 through the second display.

As described above, the first partial screen 520 and the second partial screen 530 may be output through the first display and the second display, based on a display mode set in an operating system (OS) that drives the electronic device 101.

According to various embodiments of the present disclosure, the electronic device 101 may modify and display the first partial screen 520 and the second partial screen 530, which are the parts of the first screen 510, based on whether a screen has a change. For example, the electronic device 101 may output the first partial screen by applying a burn-in resistant processing, such as applying dimming, blurring, transparency, or the like. Through the above, the electronic device 101 may reduce burn-in that may occur in the first display and the second display, even in the extended mode. As described above, in addition to an example where the first display and the second display output different screens, respectively, in an example where the first display and the second display output different parts of the first screen, respectively, the burn-in reducing method, according to various embodiments of the present disclosure, may be applied.

Figure 6A:
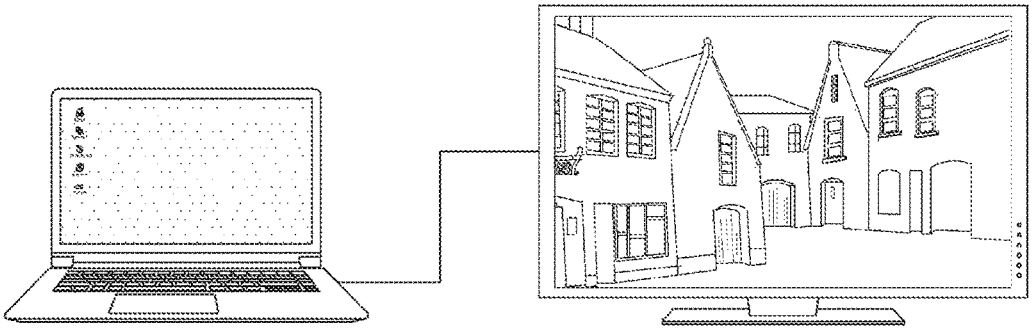
FIGS. 6A to 6C illustrate diagrams of a first screen that is modified and displayed through a first display of an electronic device according to an embodiment of the present disclosure.
Figure 6B:
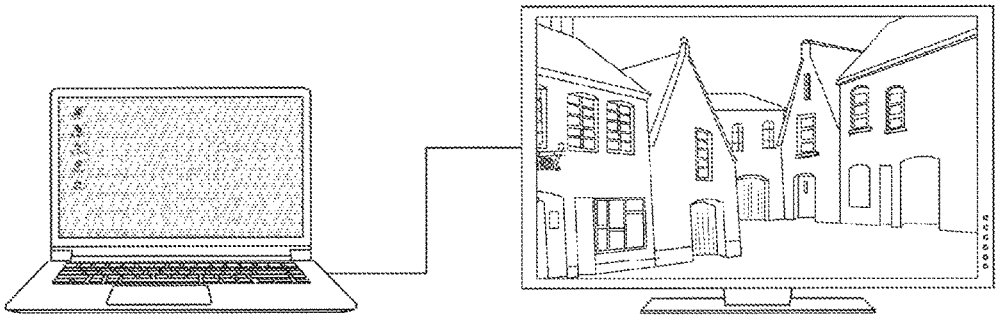
Figure 6C:
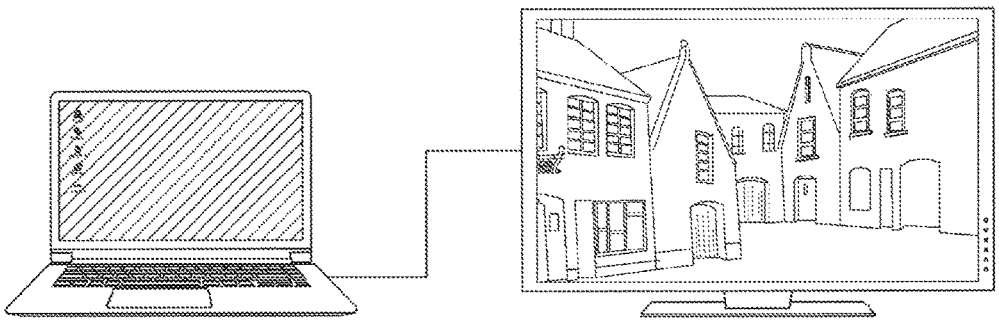

FIGS. 6A to 6C illustrate diagrams of a first partial screen of a first screen that is modified and displayed through a first display of an electronic device according to an embodiment of the present disclosure.

In FIG. 6A, an example embodiment will be described in which the electronic device 101 displays the first screen through the first display by changing the brightness of the first screen, so as to reduce burn-in that may occur when a screen that is output through the first display of the electronic device 101 is constantly maintained as the first screen, as described through FIGS. 4A and 4B. The electronic device 101 changes the brightness of the first screen by dimming the first display, so as to reduce burn-in that may occur in the first display.

For example, when the electronic device 101 determines that the first screen has no change, the electronic device may adjust the voltage of a pixel value of the first display, as shown in Table 1.

TABLE 1

| Gray | Brightness | R voltage | G voltage | B voltage |
|---|---|---|---|---|
| 255 | 100 | 2.96 V | 3.13 V | 2.75 V |
| 171 | 41.514809 | 3.18 V | 3.32 V | 3.02 V |
| 87 | 9.3875867 | 3.43 V | 3.55 V | 3.32 V |
| 59 | 3.9947171 | 3.53 V | 3.66 V | 3.43 V |
| 35 | 1.266372 | 3.65 V | 3.90 V | 3.57 V |
| 15 | 0.1963416 | 3.89 V | 4.11 V | 3.83 V |
| 1 | 0.0005077 | 4.09 V | 4.21 V | 4.06 V |

For example, the electronic device 101 may adjust the brightness by setting a voltage value of each pixel to R, G, B voltages that correspond to a Gray value. The Gray value is calculated by subtracting a normal Gray value from 256, and dividing the obtained value by a Dimming Value (DV). The DV may be a value that sets a desired brightness to which the original brightness is to be decreased when dimming is executed with respect to a display. When the normal Gray value is 1 and DV value is 5, a voltage value of each pixel may be set to R, G, B values corresponding to the Gray value of 51. The above described brightness adjusting method is merely an example for illustrative purposes, and the present disclosure may not be limited thereto.

In FIG. 6B, an example embodiment will be described in which the electronic device 101 displays the first screen in the first display by applying a blurring effect to the first screen, so as to reduce burn-in that may occur in the first display. The electronic device 101 may reduce burn-in that may occur in the first display by applying the blurring effect to the first screen.

For example, the electronic device 101 may store the first screen displayed through the first display in a temporary buffer. The electronic device 101 applies a blurring algorithm to the first screen that is stored in the temporary buffer, transfers the first screen to which the blurring algorithm is applied to a frame buffer, and outputs, through the first display, a screen corresponding to the first screen where the blurring effect is applied.

For example, the blurring algorithm may group pixels of the first display into groups based on a predetermined unit, and may reassign each pixel with an average value of a pixel group where a corresponding pixel belongs, as each pixel value.

In FIG. 6C, an example embodiment will be described in which the electronic device 101 displays the first screen in the first display by changing the transparency of the first screen, so as to reduce burn-in that may occur in the first display. The electronic device 101 may reduce burn-in that may occur in the first display by changing the transparency of the first screen.

For example, the electronic device 101 may change the transparency of the first screen by using a transparency applying filter that is included in an On Screen Display (OSD) of the first display.

Also, although not illustrated in FIGS. 6A to 6C, when it is determined that the first screen has no change, the electronic device 101 may display a screen saver through the first display so as to reduce burn-in that may occur in the first display. Also, the electronic device 101 may turn off outputting a screen through the first display.

Although FIGS. 6A through 6C have described the example embodiments of applying the burn-in resistant processing, such as applying dimming, blurring, transparency or the like, with respect to the entire first screen output through the first display, the present disclosure may not be limited thereto. For example, although not illustrated, the electronic device 101 may apply burn-in resistant processing, such as applying dimming, blurring, transparency, or the like, with respect to at least a part of the first screen. Also, the electronic device 101 may display a screen saver in at least a part of the first screen, and may turn off outputting in at least a part of the first screen.

Figure 7A:
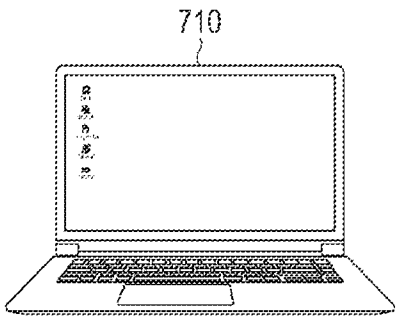
FIGS. 7A to 7C illustrate diagrams of a first screen that is modified and displayed based on type information of a first display, according to an embodiment of the present disclosure.
Figure 7B:
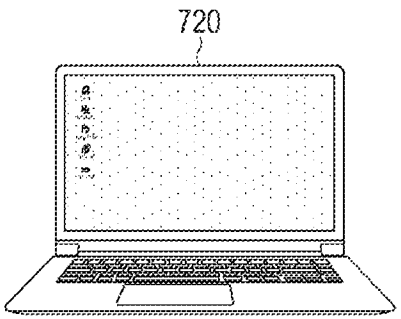
Figure 7C:
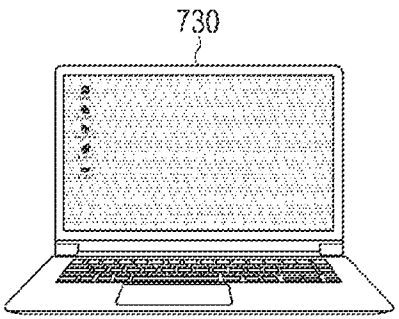

FIGS. 7A-7C illustrate a diagram of a first screen that is modified and displayed based on type information of a first display, according to an embodiment of the present disclosure.

As illustrated in FIG. 7, the electronic device 101 applies the degree of a change to be made in the first screen to be different based on the type information of the first display. In an example embodiment of an electronic device 720 and an electronic device 730, the degree of a change to be made in brightness may be different based on the electronic device 710 that displays the first screen.

For example, it is assumed that the display type of the electronic device 720 is an LCD, and the display type of the electronic device 730 is an AMOLED. An AMOLED type of display is sensitive to a burn-in effect and an LCD type of display is relatively less sensitive to the burn-in effect when compared to the AMOLED type of display.

Therefore, the electronic device 720 may display the first screen through a display by setting a brightness value to a first value, and the electronic device 730 may display the first screen through a display by setting a brightness value to a second value that is greater than the first value. The electronic device 730 may modify the first screen by setting a brightness value to be larger than the electronic device 720, by taking into consideration that the AMOLED type of display is sensitive to the burn-in effect.

Figure 8:
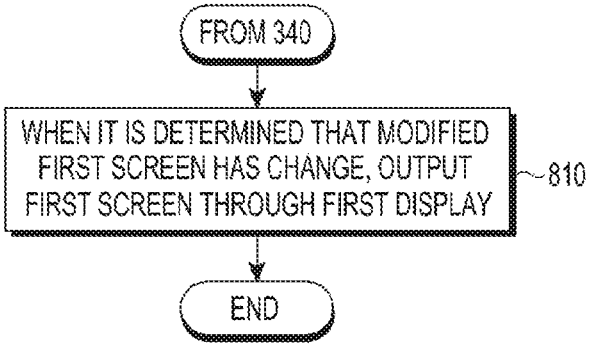
FIG. 8 illustrates a process for an electronic device to output a first screen when a modified first screen has a change, according to an embodiment of the present disclosure.

FIG. 8 illustrates a process for an electronic device to output a first screen when a modified first screen has a change, according to an embodiment of the present disclosure.

In operation 810, when it is determined that the modified first screen has a change, the electronic device 101 outputs the first screen through a first display. The processor 120 modifies the first screen and displays the same through the first display, and then, determines whether the modified first screen has a change.

After the first electronic device 101 displays the modified first screen through the first display by determining that the first screen has no change during a predetermined period of time, when it is determined that the modified first screen has a change, the first electronic device displays the first screen again through the first display. Through the above, when a user executes an application through the first display, the electronic device 101 may again display the original first screen to which brightness, transparency, or blurring effect is not applied.

Figure 9:
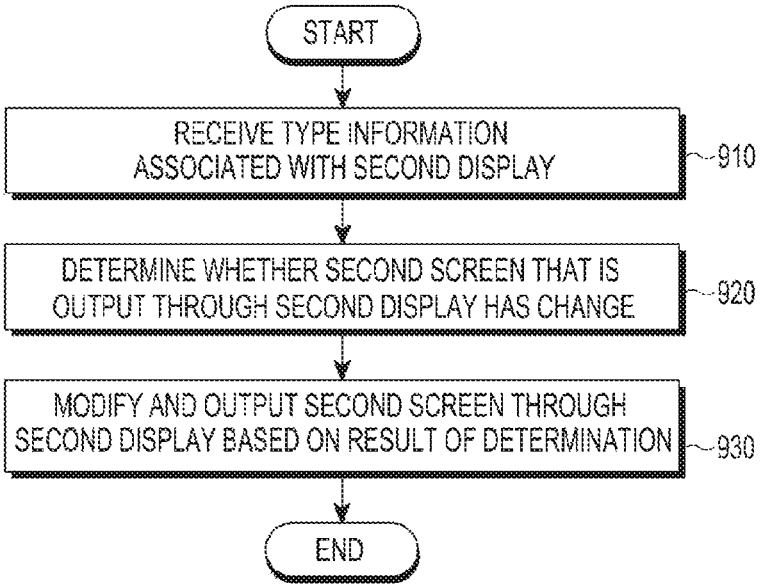
FIG. 9 illustrates a process for an electronic device to modify and display a second screen through a second display, according to an embodiment of the present disclosure.

FIG. 9 illustrates a process for an electronic device to modify and display a second screen through a second display, according to an embodiment of the present disclosure.

In operation 910, the electronic device 101 receives type information associated with the second display from the second display that is connected to the electronic device 101. For example, the electronic device 101 receives EDID information from the second display, and determines type information associated with the second display included in the EDID information.

According to an embodiment of the present disclosure, the electronic device 101 may determine whether to modify the second screen that is displayed through the second display, based on the received type information associated with the second display. For example, when the second display is a display that is not sensitive to burn-in, the electronic device 101 may not modify the second screen even though the second partial screen has no change. Also, when the second display is a display that is sensitive to burn-in, the electronic device 101 may modify and output the second partial screen when the second screen has no change.

In operation 920, the electronic device 101 determines whether the second screen that is displayed through the second display has a change, based on the received type information associated with the second display. For example, the processor 120 may determine whether the second screen has a change based on the entire second screen or at least a part of the second screen, which is set in advance.

In operation 930, the electronic device 101 modifies and outputs the second screen through the second display based on the result of the determination. The processor 101 may modify and output the second display that is output through the second display when the second screen has no change during a predetermined period of time, so as to reduce burn-in that may occur in the second display.

The modified second screen may be at least one of a screen obtained by changing the brightness of at least a part of the second screen, a screen obtained by applying a blurring effect to at least a part of the second screen, a screen obtained by changing the transparency of at least a part of the second screen, a screen obtained by applying a screen saver to at least a part of the second screen, and a screen that does not output information in at least a part of the second screen, based on the received type information associated with the second display.

Figure 10:
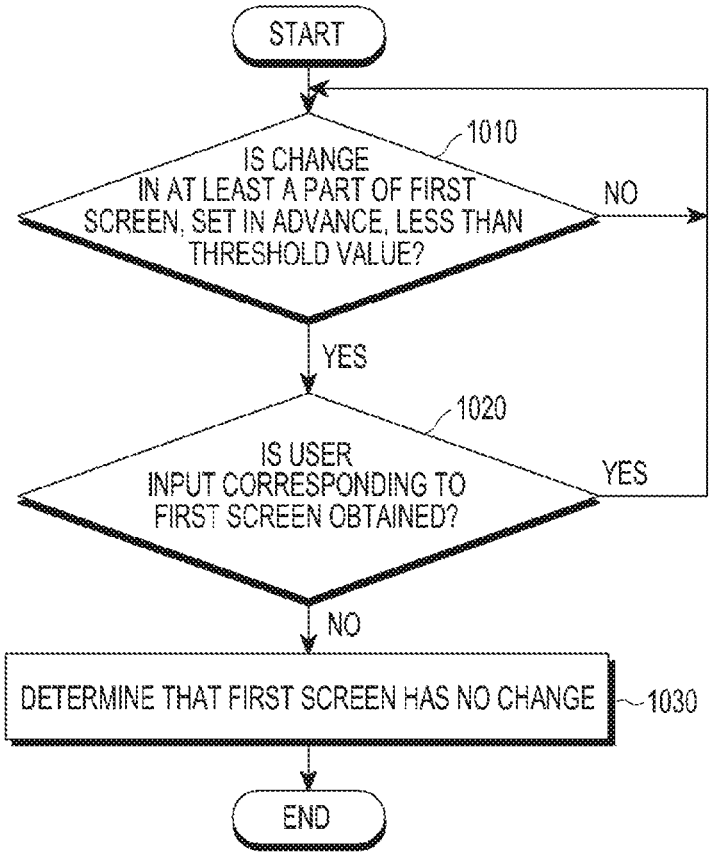
FIG. 10 illustrates a process for an electronic device to determine whether a first screen has a change according to an embodiment of the present disclosure.

FIG. 10 illustrates a process for an electronic device to determine whether a first screen has a change according to an embodiment of the present disclosure.

In operation 1010, the electronic device 101 determines whether a change occurring in the first screen that is output through a first display, during a predetermined period of time, is less than a threshold value. When the change in the first screen is greater than or equal to a threshold value, it is determined that the first screen has a change. The threshold value may be set in advance. Also, the electronic device 101 may determine whether a change in the entire first screen is less than the threshold value, and may determine whether a change in at least a part of the first screen, which is set in advance, is less than the threshold value.

In operation 1020, the electronic device 101 determines whether a user input corresponding to the first screen is obtained. When the user input corresponding to the first screen is obtained, it is determined that the first screen has a change.

In operation 1030, when the user input corresponding to the first screen is not obtained, the electronic device 101 determines that the first screen has no change. For example, the electronic device 101 may determine whether the user input is obtained through information on whether a user interface associated with the user input is displayed or moves in the first screen. Also, the electronic device 101 may determine whether the user input is obtained based on the degree of a movement state of the user interface in the first screen.

Although FIG. 10 has described that information on whether a change in the first screen is less than a threshold value and information on whether a user input corresponding to the first screen is obtained are all taken into consideration, so as to determine whether the first screen has a change, the present disclosure may not be limited thereto. For example, the electronic device 101 may determine whether the first screen has a change by determining only whether a change in the first screen is less than a threshold value, or may determine whether the first screen has a change by determining only whether a user input corresponding to the first screen is obtained.

Figure 11:
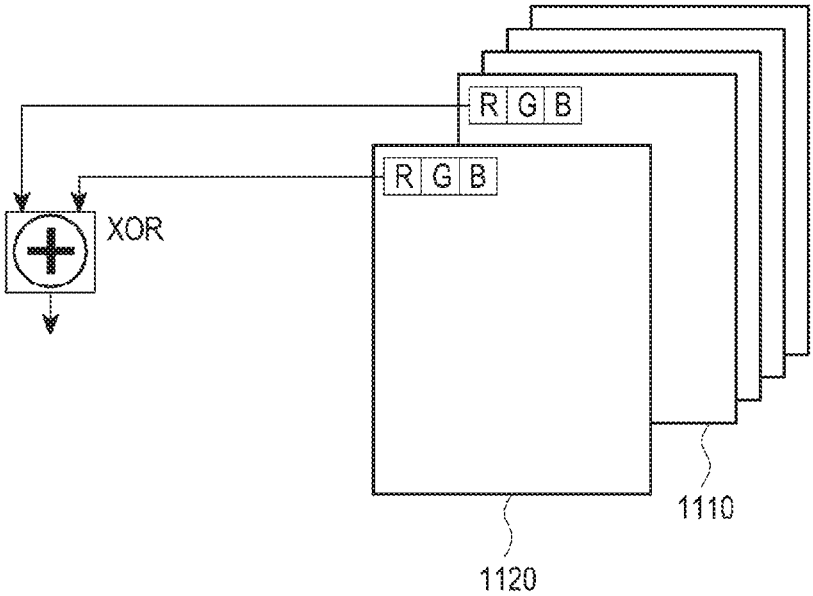
FIG. 11 illustrates a diagram of a method for an electronic device to determine whether a first screen has a change according to an embodiment of the present disclosure.

FIG. 11 illustrates a diagram of a method for an electronic device to determine whether a first screen has a change according to an embodiment of the present disclosure.

FIG. 11 describes a method of determining whether a change in a first screen is less than a threshold value. The method described hereinafter may be applied to at least a part of the first screen, in addition to the entire first screen.

According to an embodiment of the present disclosure, the electronic device 101 may compare data of the first screen of a current display frame buffer 1110 and data of the first screen of a previous display frame buffer 1120, so as to determine a degree of a change occurring in the first screen during T seconds, which is set in advance. For example, a Total Diff (TD) value indicating the number of pixels that change may be obtained by executing an XOR operation for each pixel, and counting pixels of which an XOR operation result is 1. The electronic device 101 may readily and quickly determine a degree of a change occurring in the first screen using the XOR operation for determining whether a pixel changes. When the TD value is less than a predetermined threshold value, a change in the screen is little, and thus, it is determined that the screen has no change. However, when the TD value is greater than or equal to the threshold value, it is determined that the screen has a change. The screen may be modified and output, or the modified screen may be restored to the original screen by applying dimming, blurring, or the like to reduce burn-in, based on the TD value.

Figure 12:
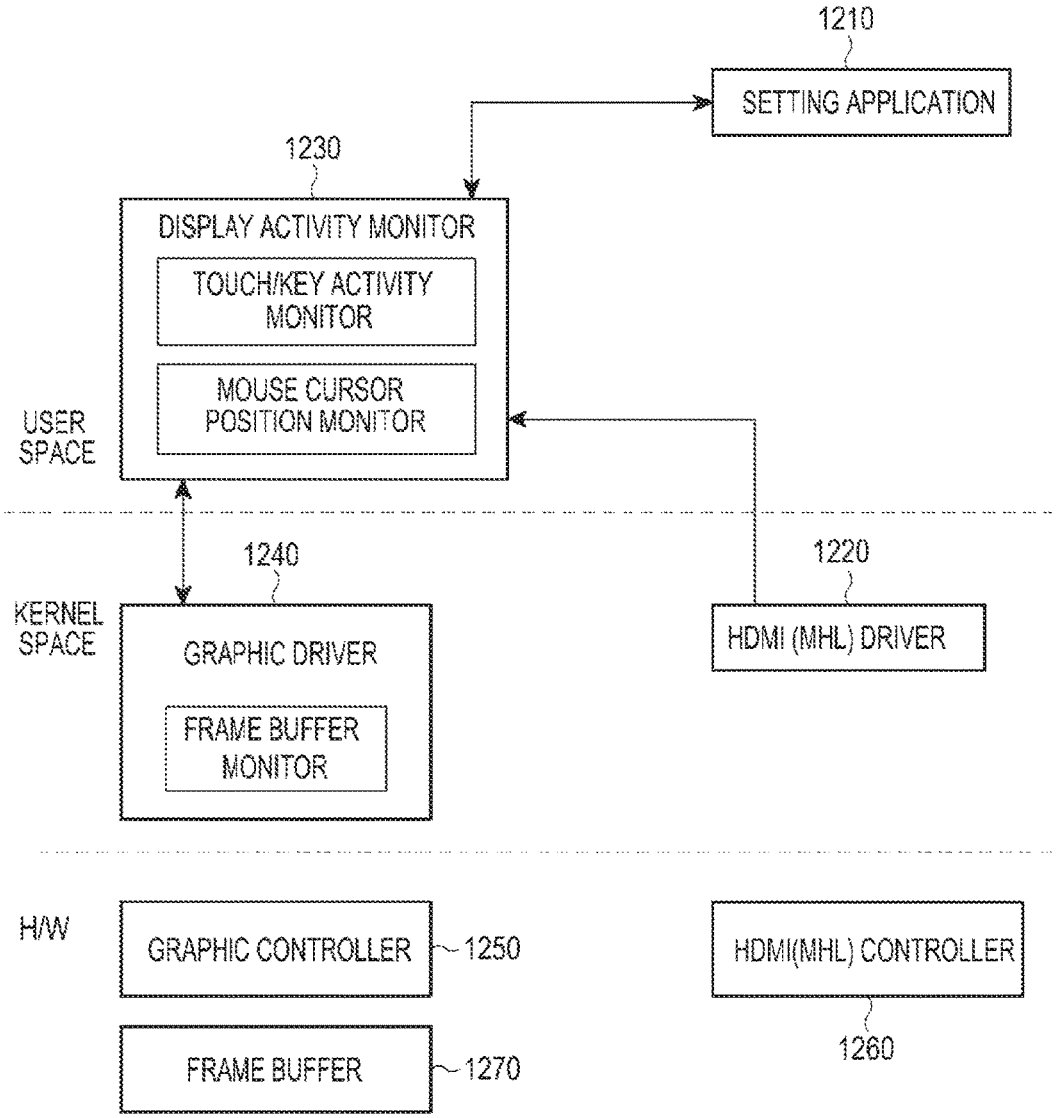
FIG. 12 illustrates a block diagram of a software module for executing a burn-in reducing method according to an embodiment of the present disclosure.

FIG. 12 illustrates a block diagram of a software module for executing a burn-in reducing method according to an embodiment of the present disclosure.

The electronic device 101 according to an embodiment of the present disclosure, may include a setting application 1210, a HDMI (MHL) driver 1220, a display activity monitor 1230, a graphic driver 1240, a graphic controller 1250, a HDMI (MHL) controller 1260, and a frame buffer 1270.

According to an embodiment of the present disclosure, the setting application 1210 and the display activity monitor 1230 may be driven in a user space. A user may select whether to use a burn-in reducing method, according to an embodiment of the present disclosure, through the setting application 1210.

The HDMI (MHL) driver 1220 may connect an external monitor through a HDMI or MHL port, and may enable the user to use the external monitor.

The display activity monitor 1230 may include a touch/key activity monitor and a mouse cursor position monitor. The display activity monitor 1230 may be a module that executes a control to modify and output a screen displayed in a display. The display activity monitor 1230 may receive an event associated with connecting an external monitor, from the HDMI (MHL) driver 1220. Also, the display activity monitor 1230 may receive, from the graphic driver 1240, a signal indicating whether a screen displayed in the display has a change.

The touch/key activity monitor may determine whether a touch input on a display and a key input, such as a volume or home button, are obtained. When it is determined that the touch input and the key input are obtained through the touch/key activity monitor, the display activity monitor 1230 determines that a user uses the display of the electronic device 101 and applies dimming, blurring, or transparency processing so as to display a screen by restoring the modified screen to the original screen.

The mouse cursor position monitor may monitor and detect the position of a mouse when the mouse is used by being connected to the electronic device 101. When the position of the mouse cursor is detected from the display of the electronic device 101 and an input through the mouse is obtained, the display activity monitor 1230 may restore the modified screen to the original screen and display the same through the display. In the embodiment where the position of the mouse cursor is detected from an external display, even though an input through the mouse is obtained, the display activity monitor 1230 may not restore the modified screen displayed through the display to the original screen.

The graphic driver 1240 may execute a control to output a screen through the display of the electronic device 101. The graphic driver 1240 may include a frame buffer monitor for determining whether the screen displayed in the display has a change.

The frame buffer monitor may compare the screen displayed in the display with screen data stored in the frame buffer 1270, and may determine a change in the screen displayed through the display.

The graphic driver 1240 may transmit, to the display activity monitor 1230, a signal indicating whether the screen displayed through the display has a change through the frame buffer monitor.

The graphic controller 1250 may be a hardware device that processes a screen to be outputted to the display.

The HDMI (MHL) controller 1260 may execute a process to be appropriate for HDMI or MHL specifications, so as to connect an external monitor through an HDMI or MHL port.

The frame buffer 1270 may be a display memory that stores a screen to be output to the display.

Figure 13:
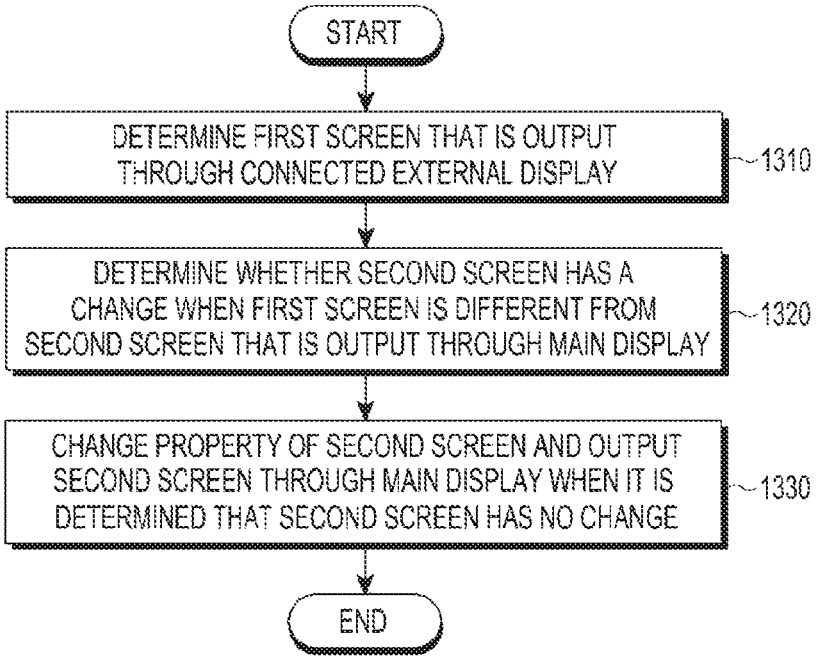
FIG. 13 illustrates a process of a burn-in reducing method of an electronic device according to an embodiment of the present disclosure.

FIG. 13 illustrates a process of a burn-in reducing method of an electronic device according to various embodiments of the present disclosure.

In operation 1310, the electronic device 101 determines a first screen that is output through a connected external display. To determine a display operation mode set in the electronic device 101, the electronic device 101 may determine the first screen that is output through the external display. For example, when the first screen output through the external display and a second screen output through a main display of the electronic device 101 are identical, the display operation mode set in the electronic device 101 may be a duplicated mode. Conversely, when the first screen output through the external display and the second screen output through the main display of the electronic device 101 are different, the display operation mode set in the electronic device 101 may be an extended mode. When the display operation mode set in the electronic deice 101 is the extended mode, the first screen and the second screen may be the parts of the entire screen generated through the electronic device 101.

In operation 1320, when the first screen is different from the second screen output through the main display of the electronic device 101, the electronic device 101 may determine whether the second screen has a change. When the display operation mode set in the electronic device 101 is the duplicated mode, the first screen and the second screen output through the main display and the external display are identical, and thus, burn-in may hardly occur in the main display and the external display. In this instance, the electronic device 101 may determine whether the second screen has a change, but the efficiency for reducing burn-in may be low.

When the display operation mode set in the electronic device 101 is the extended mode, the first screen and the second screen output through the main display and the external display are different, and thus, burn-in may occur in at least one of the main display and the external display. Therefore, the electronic device 101 may determine whether the second screen has a change. Although FIG. 13 has provided descriptions from the perspective of an architecture of determining whether the second screen that is output through the main display has a change, the electronic device 101 may determine whether the first screen that is output through the external display has a change.

When it is determined that the second screen has no change during a predetermined period of time, the electronic device 101 may change a property of the second screen and may output the second screen through the main display in operation 1330. For example, the electronic device 101 may output the second screen by changing the brightness, transparency, or the like.

According to an embodiment of the present disclosure, when the electronic device 101 determines whether the first screen has a change, and it is determined that the first screen has no change, the electronic device 101 changes a property of the first screen and outputs the first screen through the external display.

Figure 14:
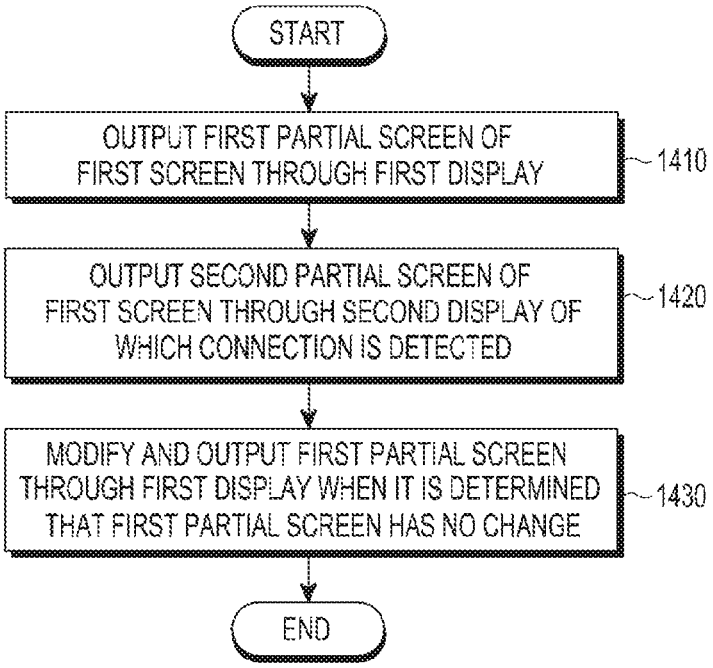
FIG. 14 illustrates a process of a burn-in reducing method of an electronic device according to an embodiment of the present disclosure.

FIG. 14 illustrates a process of a burn-in reducing method of an electronic device according to an embodiment of the present disclosure.

In operation 1410, the electronic device 101 outputs a first partial screen of a first screen through a first display. In an example where a display operation mode set in the electronic device 101 is an extended mode, the electronic device 101 may output the first partial screen through the first display when a second display is connected.

In operation 1420, the electronic device 101 outputs a second partial screen of the first screen through the second display of which a connection is detected. As described above when the display operation mode set in the electronic device 101 is an extended mode, the electronic device 101 may output, through the second display, the second partial screen that is different from the first partial screen.

In operation 1430, when it is determined that the first partial screen has no change, the electronic device 101 modifies and outputs the first partial screen through the first display. When the first partial screen that is output through the first display has no change, burn-in may occur in the first display and image sticking may remain.

Therefore, when it is determined that the first partial screen has no change, the electronic device 101 may modify and output the first partial screen. Through the above, the electronic device 101 may reduce burn-in that may occur in the first display.

According to various embodiments of the present disclosure, there is provided a method of reducing burn-in occurring in a display of an electronic device, the method including: outputting a first screen through a first display; outputting a second screen through a second display of which a connection is detected; determining whether a change occurs in the first screen that is output through the first display, as the connection of the second display is detected; and modifying and outputting the first screen through the first display based on a result of the determination.

According to various embodiments of the present disclosure, the modified first screen may be at least one of a screen obtained by changing the brightness of at least a part of the first screen, a screen obtained by applying a blurring effect to at least a part of the first screen, a screen obtained by changing the transparency of at least a part of the first screen, a screen obtained by applying a screen saver to at least a part of the first screen, and a screen that does not output information in at least a part of the first screen.

According to various embodiments of the present disclosure, the first screen may be modified and output based on a type of the first display.

According to various embodiments of the present disclosure, the burn-in reducing method may further include outputting the first screen through the first display when it is determined that a change occurs in the modified first screen.

According to various embodiments of the present disclosure, the burn-in reducing method may further include receiving, from the second display, type information associated with the second display.

According to various embodiments of the present disclosure, the burn-in reducing method may further include: determining whether a change occurs in the second screen that is output through the second display, based on the received type information associated with the second display; and modifying and outputting the second screen through the second display, based on a result of the determination.

According to various embodiments of the present disclosure, the modified second screen may be at least one of a screen obtained by changing the brightness of at least a part of the second screen, a screen obtained by applying a blurring effect to at least a part of the second screen, a screen obtained by changing the transparency of at least a part of the second screen, a screen obtained by applying a screen saver to at least a part of the second screen, and a screen that does not output information in at least a part of the second screen, based on the received type information of the second display.

According to various embodiments of the present disclosure, the operation of determining whether the change occurs in the first screen, may include: determining that the first screen has no change when a change occurring in at least a part of the first screen, which is set in advance, is less than a threshold value during a predetermined period of time.

According to various embodiments of the present disclosure, the operation of determining whether the change occurs in the first screen, may include: determining that the first screen has no change when a user input corresponding to the first screen is not obtained during a predetermined period of time.

According to various embodiments of the present disclosure, there is provided an electronic device for reducing burn-in of a display, the electronic device including: a first display that outputs a first screen; and a processor that determines whether a change occurs in the first screen that is output through the first display, as a connection with a second display that outputs a second screen is detected, and modifies and outputs the first screen through the first display based on a result of the determination.

According to various embodiments of the present disclosure, the modified first screen may be at least one of a screen obtained by changing the brightness of at least a part of the first screen, a screen obtained by applying a blurring effect to at least a part of the first screen, a screen obtained by changing the transparency of at least a part of the first screen, a screen obtained by applying a screen saver to at least a part of the first screen, and a screen that does not output information in at least a part of the first screen.

According to various embodiments of the present disclosure, the first screen may be modified and output based on a type of the first display.

According to various embodiments of the present disclosure, the processor may output the first screen through the first display when it is determined that the modified first screen has a change.

According to various embodiments of the present disclosure, the electronic device may further include a communication module that receives, from the second display, type information associated with the second display.

According to various embodiments of the present disclosure, the processor may determine whether a change occurs in the second screen that is output through the second display, based on the received type information of the second display, and may modify and output the second screen through the second display based on a result of the determination.

According to various embodiments of the present disclosure, the modified second screen may be at least one of a screen obtained by changing the brightness of at least a part of the second screen, a screen obtained by applying a blurring effect to at least a part of the second screen, a screen obtained by changing the transparency of at least a part of the second screen, a screen obtained by applying a screen saver to at least a part of the second screen, and a screen that does not output information in at least a part of the second screen, based on the received type information associated with the second display.

According to various embodiments of the present disclosure, the processor may determine that the first screen has no change when a change in at least a part of the first screen, which is set in advance, is less than a threshold value during a predetermined period of time.

According to various embodiments of the present disclosure, the processor may determine that the first screen has no change when a user input corresponding to the first screen is not obtained during a predetermined period of time.

According to various embodiments of the present disclosure, there is provided a method of reducing burn-in occurring in a display of an electronic device, the method including: outputting a first partial screen of a first screen through a first display; outputting a second partial screen of the first screen through a second display of which a connection is detected; and when it is determined that the first partial screen has no change after the connection of the second display is detected, modifying and outputting the first partial screen through the first display.

According to various embodiments of the present disclosure, the modified first partial screen may be at least one of a screen obtained by changing the brightness of at least a part of the first partial screen, a screen obtained by applying a blurring effect to at least a part of the first partial screen, a screen obtained by changing the transparency of at least a part of the first partial screen, a screen obtained by applying a screen saver to at least a part of the first partial screen, and a screen that does not output information in at least a part of the first partial screen.

Figure 15:
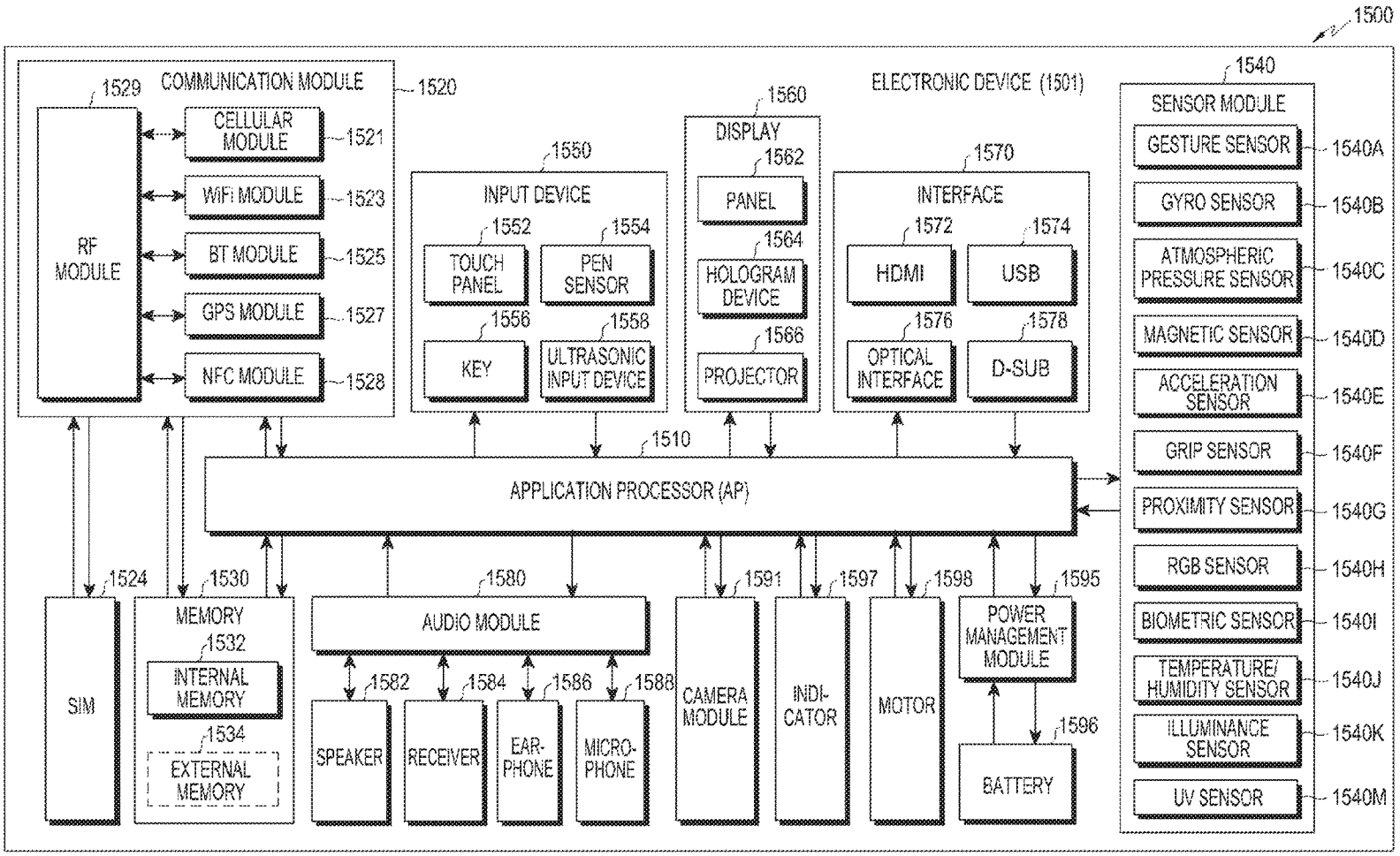
FIG. 15 illustrates a block diagram of an electronic device according to various embodiments of the present disclosure.

FIG. 15 illustrates a block diagram of an electronic device 1501 according to various embodiments. For example, the electronic device 1501 may include the whole or part of the electronic device 101 illustrated in FIG. 1. The electronic device 1501 may include at least one processor 1510 (e.g., an Application Processor (AP)), a communication module 1520, a Subscriber Identification Module (SIM) card 1524, a memory 1530, a sensor module 1540, an input device 1550, a display 1560, an interface 1570, an audio module 1580, a camera module 1591, a power management module 1595, a battery 1596, an indicator 1597, and a motor 1598.

The processor 1510 may control a plurality of hardware or software component elements connected to the processor 1510 by driving an operating system or an application program, and may perform the processing of various pieces of data and calculations. The processor 1510 may be embodied as, for example, a System on Chip (SoC). According to an embodiment of the present disclosure, the processor 1510 may further include a Graphic Processing Unit (GPU) and/or an image signal processor. The processor 1510 may include at least some (e.g., a cellular module 1521) of the component elements illustrated in FIG. 15. The processor 1510 may load, into a volatile memory, instructions or data received from at least one (e.g., a non-volatile memory) of the other component elements and may process the loaded instructions or data, and may store various data in a non-volatile memory.

The communication module 1520 may have a configuration equal or similar to that of the communication interface 170 of FIG. 1. The communication module 1520 may include, for example, a cellular module 1521, a Wi-Fi module 1523, a Bluetooth module 1525, a GNSS module 1527 (e.g., a GPS module, a Glonass module, a Beidou module, or a Galileo module), an NFC module 1528, and a Radio Frequency (RF) module 1529.

The cellular module 1521, for example, may provide a voice call, image call, a text message service, or an Internet service through a communication network. According to an embodiment of the present disclosure, the cellular module 1521 may distinguish and authenticate electronic devices 1501 within a communication network using a subscriber identification module (e.g., an SIM card 1524). According to an embodiment of the present disclosure, the cellular module 1521 may perform at least some of the functions that the processor 1510 may provide. According to an embodiment of the present disclosure, the cellular module 1521 may include a Communication Processor (CP).

Each of the Wi-Fi module 1523, the BT module 1525, the GNSS module 1527, and the NFC module 1528 may include, for example, a processor for processing data that is transmitted and received through a corresponding module. According to an embodiment of the present disclosure, at least some (e.g., two or more) of the cellular module 1521, the Wi-Fi module 1523, the Bluetooth module 1525, the GNSS module 1527, and the NFC module 1528 may be included in one Integrated Chip (IC) or IC package.

The RF module 1529 may transmit/receive, for example, a communication signal (e.g., an RF signal). The RF module 1529 may include, for example, a transceiver, a Power Amp Module (PAM), a frequency filter, a Low Noise Amplifier (LNA), an antenna, or the like. According to another embodiment of the present disclosure, at least one of the cellular module 1521, the Wi-Fi module 1523, the Bluetooth module 1525, the GNSS module 1527, and the NFC module 1528 may transmit and receive RF signals through a separate RF module.

The subscriber identification module 1524 may include, for example, a card including a subscriber identity module and/or an embedded SIM, and may contain unique identification information (e.g., an Integrated Circuit Card Identifier (ICCID)) or subscriber information (e.g., an International Mobile Subscriber Identity (IMSI)).

The memory 1530 (e.g., the memory 130) may include, for example, an internal memory 1532 or an external memory 1534. The embedded memory 1532 may include, for example, at least one of a volatile memory (e.g., a Dynamic Random Access Memory (DRAM), a Static RAM (SRAM), a Synchronous Dynamic RAM (SDRAM), and the like) and a non-volatile memory (e.g., a One Time Programmable Read Only Memory (OTPROM), a Programmable ROM (PROM), an Erasable and Programmable ROM (EPROM), an Electrically Erasable and Programmable ROM (EEPROM), a mask ROM, a flash ROM, a flash memory (e.g., a NAND flash memory or a NOR flash memory), a hard disc drive, a Solid State Drive (SSD), and the like).

An external memory 1534 may further include a flash drive, for example, a Compact Flash (CF), a Secure Digital (SD), a Micro Secure Digital (Micro-SD), a Mini Secure Digital (Mini-SD), an eXtreme Digital (xD), a Multi-Media Card (MMC), a memory stick, or the like. The external memory 1534 may be functionally and/or physically connected to the electronic device 1501 through various interfaces.

The sensor module 1540, for example, may measure a physical quantity or detect an operation state of the electronic device 1501, and may convert the measured or detected information into an electrical signal. The sensor module 1540 may include, for example, at least one of a gesture sensor 1540A, a gyro sensor 1540B, an atmospheric pressure sensor 1540C, a magnetic sensor 1540D, an acceleration sensor 1540E, a grip sensor 1540F, a proximity sensor 1540G, a color sensor 1540H (e.g., a red, green, blue (RGB) sensor), a biometric sensor 1540I, a temperature/humidity sensor 1540I, an illuminance sensor 1540K, and an ultraviolet (UV) sensor 1540M. Additionally or alternatively, the sensor module 1540 may include, for example, an E-nose sensor, an electromyography (EMG) sensor, an electroencephalogram (EEG) sensor, an electrocardiogram (ECG) sensor, an Infrared (IR) sensor, an iris sensor, and/or a fingerprint sensor. The sensor module 1540 may further include a control circuit for controlling at least one sensor included therein. According to an embodiment of the present disclosure, the electronic device 1501 may further include a processor configured to control the sensor module 1540 as a part of the processor 1510 or separately from the processor 1510, and may control the sensor module 1540 while the processor 1510 is in a sleep state.

The input device 1550 may include, for example, a touch panel 1552, a (digital) pen sensor 1554, a key 1556, or an ultrasonic input device 1558. The touch panel 1552 may use at least one of, for example, a capacitive type, a resistive type, an infrared type, and an ultrasonic type. Also, the touch panel 1552 may further include a control circuit. The touch panel 1552 may further include a tactile layer and may provide a tactile reaction to the user.

The (digital) pen sensor 1554 may include, for example, a recognition sheet which is a part of the touch panel or is separated from the touch panel. The key 1556 may include, for example, a physical button, an optical key or a keypad. The ultrasonic input device 1558 may detect ultrasonic wavers generated by an input tool, through a microphone (e.g., a microphone 1588), and may identify data corresponding to the detected ultrasonic waves.

The display 1560 (e.g., the display 160) may include a panel 1562, a hologram device 1564 or a projector 1566. The panel 1562 may include a configuration identical or similar to that of the display 160 illustrated in FIG. 1. The panel 1562 may be embodied to be, for example, flexible, transparent, or wearable. The panel 1562 and the touch panel 1552 may be embodied as one module. The hologram device 1564 may show a three dimensional image in the air by using an interference of light. The projector 1566 may display an image by projecting light onto a screen. The screen may be located, for example, inside or outside the electronic device 1501. According to an embodiment of the present disclosure, the display 1560 may further include a control circuit for controlling the panel 1562, the hologram device 1564, or the projector 1566.

The interface 1570 may include, for example, a High-Definition Multimedia Interface (HDMI) 1572, a Universal Serial Bus (USB) 1574, an optical interface 1576, or a D-subminiature (D-sub) 1578. The interface 1570 may be included in, for example, the communication interface 170 illustrated in FIG. 1. Additionally or alternatively, the interface 1570 may include, for example, a Mobile High-definition Link (MHL) interface, a Secure Digital (SD) card/Multi-Media Card (MMC) interface, or an Infrared Data Association (IrDA) standard interface.

The audio module 1580 may bilaterally convert, for example, a sound and an electrical signal. At least some component elements of the audio module 1580 may be included in, for example, the input/output interface 155 illustrated in FIG. 1. The audio module 1580 may process sound information that is input or output through, for example, a speaker 1582, a receiver 1584, earphones 1586, the microphone 1588 or the like.

The camera module 1591 is, for example, a device that may photograph a still image and a dynamic image. According to an embodiment of the present disclosure, the camera module 291 may include one or more image sensors (e.g., a front sensor or a back sensor), a lens, an Image Signal Processor (ISP) or a flash (e.g., LED, xenon lamp, or the like).

The power management module 1595 may manage, for example, power of the electronic device 1501. According to an embodiment of the present disclosure, the power management module 1595 may include a Power Management Integrated Circuit (PMIC), a charger Integrated Circuit (IC), or a battery or fuel gauge. The PMIC may use a wired and/or wireless charging method. Examples of the wireless charging method may include, for example, a magnetic resonance method, a magnetic induction method, an electromagnetic method, and the like. Additional circuits (e.g., a coil loop, a resonance circuit, a rectifier, and the like) for wireless charging may be further included. The battery gauge may measure, for example, a residual quantity of the battery 1596, and a voltage, a current, or a temperature during the charging. The battery 1596 may include, for example, a rechargeable battery and/or a solar battery.

The indicator 1597 may display a particular state (e.g., a booting state, a message state, a charging state, or the like) of the electronic device 1501 or a part (e.g., the processor 1510) of the electronic device 1501. The motor 1598 may convert an electrical signal into a mechanical vibration, and may generate a vibration, a haptic effect, or the like. Although not illustrated, the electronic device 1501 may include a processing unit (e.g., a GPU) for supporting a mobile television (TV). The processing unit for supporting the mobile TV may, for example, process media data according to a certain standard such as Digital Multimedia Broadcasting (DMB), Digital Video Broadcasting (DVB), or mediaFLO™.

Each of the above-described component elements of hardware according to the present disclosure may be configured with one or more components, and the names of the corresponding component elements may vary based on the type of electronic device. The electronic device according to various embodiments of the present disclosure may include at least one of the aforementioned elements. Some elements may be omitted or other additional elements may be further included in the electronic device. Also, some of the hardware components according to various embodiments may be combined into one entity, which may perform functions identical to those of the relevant components before the combination.

The term "module" as used herein may, for example, mean a unit including one of hardware, software, and firmware or a combination of two or more of them. The "module" may be interchangeably used with, for example, the term "unit", "logic", "logical block", "component", or "circuit". The "module" may be a minimum unit of an integrated component element or a part thereof. The "module" may be a minimum unit for performing one or more functions or a part thereof. The "module" may be mechanically or electronically implemented. For example, the "module" according to the present disclosure may include at least one of an Application-Specific Integrated Circuit (ASIC) chip, a Field-Programmable Gate Arrays (FPGA), and a programmable-logic device for performing operations which has been known or are to be developed hereinafter.

According to various embodiments, at least some of the devices (for example, modules or functions thereof) or the method (for example, operations) according to the present disclosure may be implemented by a command stored in a computer-readable storage medium in a programming module form. The instruction, when executed by a processor (e.g., the processor 120), may cause the one or more processors to execute the function corresponding to the instruction. The computer-readable storage medium may be, for example, the memory 130.

The computer readable recoding medium may include a hard disk, a floppy disk, magnetic media (e.g., a magnetic tape), optical media (e.g., a Compact Disc Read Only Memory (CD-ROM) and a Digital Versatile Disc (DVD)), magneto-optical media (e.g., a floptical disk), a hardware device (e.g., a Read Only Memory (ROM), a Random Access Memory (RAM), a flash memory), and the like. In addition, the program instructions may include high class language codes, which can be executed in a computer by using an interpreter, as well as machine codes made by a compiler. The aforementioned hardware device may be configured to operate as one or more software modules in order to perform the operation of the present disclosure, and vice versa. The programming module according to the present disclosure may include one or more of the aforementioned components or may further include other additional components, or some of the aforementioned components may be omitted. Operations executed by a module, a programming module, or other component elements according to various embodiments of the present disclosure may be executed sequentially, in parallel, repeatedly, or in a heuristic manner. Further, some operations may be executed according to another order or may be omitted, or other operations may be added. Various embodiments disclosed herein are provided merely to easily describe technical details of the present disclosure and to help the understanding of the present disclosure, and are not intended to limit the scope of the present disclosure. Accordingly, the scope of the present disclosure should be construed as including all modifications or various other embodiments based on the technical idea of the present disclosure.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A method of reducing burn-in occurring in a first display of an electronic device, the method comprising:

outputting a first screen through the first display of the electronic device;

outputting a second screen through a second display connected with the electronic device, the second display being separate from the first display;

performing, by the electronic device, a determination whether a change of a screen occurs within a predetermined time in one of the first screen that is output through the first display or the second screen that is output through the second display by comparing each pixel of the screen of a current display frame buffer in a display memory of the electronic device and each pixel of the screen of a previous frame buffer in the display memory of the electronic device, the determination performed while the connection between the second display and the electronic device is detected, the determination performed based on a comparison of a value of total difference against a threshold value; and modifying, by the electronic device, the first screen that is output through the first display, if it is determined, by the electronic device, that a change does not occur in the first screen while a change occurs in the second screen, the modifying comprising changing at least one of a brightness, transparency or clarity of a part of the first screen; and outputting the modified first screen through the first display.

2. The method of claim 1, wherein the modified first screen is at least one of a screen obtained by applying a screen saver to at least a part of the first screen, and a screen that does not output information in at least a part of the first screen.

3. The method of claim 2, wherein the first screen is modified based on a type of the first display.

4. The method of claim 1, wherein the first screen is output through the first display when it is determined that a change occurs in the modified first screen output through the first display.

5. The method of claim 1, further comprising:

receiving, by the electronic device, type information associated with the second display, from the second display.

6. The method of claim 5, further comprising:

performing, by the electronic device, a determination whether the change of the screen occurs in the second screen that is output through the second display based on the received type information associated with the second display;

modifying the second screen output through the second display if it is determined that the change does not occur in the second screen; and outputting the modified second screen through the second display.

7. The method of claim 6, wherein the modified second screen is at least one of a screen obtained by changing a brightness of at least a part of the second screen, a screen obtained by applying a blurring effect to at least a part of the second screen, a screen obtained by changing a transparency of at least a part of the second screen, a screen obtained by applying a screen saver to at least a part of the second screen, and a screen that does not output information in at least a part of the second screen, based on the received type information of the second display.

8. The method of claim 1, wherein the determination of whether the change occurs in the first screen, comprises:

performing, by the electronic device, a determination that the first screen has no change when a change occurring in at least a part of the first screen, which is set in advance, is less than a threshold value during a predetermined period of time.

9. The method of claim 8, wherein the determination of whether the change occurs in the first screen comprises:

performing, by the electronic device, a determination that a change in the first screen has not occurred when a user input corresponding to the first screen is not obtained during a predetermined period of time.

10. An electronic device for reducing burn-in of a display, the electronic device comprising:

a first display that outputs a first screen; and a processor configured to:

perform a determination whether a change of a screen occurs within a predetermined time in one of the first screen that is output through the first display or a second screen that is output through a second display by comparing each pixel of the screen of a current display frame buffer in a display memory of the electronic device and each pixel of the screen of a previous frame buffer in the display memory of the electronic device, the second display being separate from the first display, the determination performed while a connection between the electronic device and the second display that outputs a second screen is detected, the determination performed based on a comparison of a value of total difference against a threshold value, modify the first screen that is output through the first display, if it is determined by the processor, that a change does not occur in the first screen while a change occurs in the second screen, the modifying comprising changing at least one of a brightness, transparency or clarity of a part of the first screen, and output the modified first screen through the first display.

11. The electronic device of claim 10, wherein the modified first screen is at least one of a screen obtained by applying a screen saver to at least a part of the first screen, and a screen that does not output information in at least a part of the first screen.

12. The electronic device of claim 11, wherein the first screen is modified based on a type of the first display.

13. The electronic device of claim 10, wherein the processor is configured to output the first screen through the first display when it is determined that a change occurs in the modified first screen output through the first display.

14. The electronic device of claim 10, further comprising:

a communication module configured to receive type information associated with the second display, from the second display.

15. The electronic device of claim 14, wherein the processor is configured to perform a determination whether the change of the screen occurs in the second screen that is output through the second display based on the received type information of the second display, modify the second screen output through the second display if it is determined that the change does not occur in the second screen and output the modified second screen through the second display.

16. The electronic device of claim 15, wherein the modified second screen is at least one of a screen obtained by changing a brightness of at least a part of the second screen, a screen obtained by applying a blurring effect to at least a part of the second screen, a screen obtained by changing a transparency of at least a part of the second screen, a screen obtained by applying a screen saver to at least a part of the second screen, and a screen that does not output information in at least a part of the second screen, based on the received type information associated with the second display.

17. The electronic device of claim 10, wherein the processor is configured to perform a determination that a change in the first screen has not occurred when a change in at least a part of the first screen, which is set in advance, is less than a threshold value during a predetermined period of time.

18. The electronic device of claim 17, wherein the processor is configured to perform a determination that a change in first screen has not occurred when a user input corresponding to the first screen is not obtained during a predetermined period of time.

19. A method of reducing burn-in occurring in a display of an electronic device, the method comprising:

outputting a first partial screen of a first screen through a first display of the electronic device;

outputting a second partial screen of the first screen through a second display connected with the electronic device, the second display being separate from the first display, wherein the second partial screen includes image content different from image content of the first partial screen; and modifying the image content of the first partial screen output through the first display, if it is determined by the electronic device that the first partial screen has no change based on a comparison for each pixel of the first partial screen of a current display frame buffer in a display memory of the electronic device and each pixel of the first partial screen of a previous frame buffer in the display memory of the electronic device after the connection between the electronic device and the second display is detected, the determination performed based on a comparison of total difference against a threshold value, the modifying comprising changing at least one of a brightness, transparency or clarity of the first partial screen output, outputting the modified first partial screen through the first display.

20. The method of claim 19, wherein the modified first partial screen is at least one of a screen obtained by applying a screen saver to at least a part of the first partial screen, and a screen that does not output information in at least a part of the first partial screen.

* * * * *